US008607538B2

(12) United States Patent
Cerè

(10) Patent No.: US 8,607,538 B2
(45) Date of Patent: Dec. 17, 2013

(54) APPARATUS FOR CHANGING FILM REELS

(75) Inventor: Mauro Cerè, Loiano (IT)

(73) Assignee: Aetna Group S.p.A. (IT)

( * ) Notice: Subject to any disclaimer, the term of this patent is extended or adjusted under 35 U.S.C. 154(b) by 334 days.

(21) Appl. No.: 12/514,949

(22) PCT Filed: Nov. 16, 2007

(86) PCT No.: PCT/IB2007/003505

§ 371 (c)(1),
(2), (4) Date: Sep. 24, 2009

(87) PCT Pub. No.: WO2008/059359

PCT Pub. Date: May 22, 2008

(65) Prior Publication Data

US 2010/0025517 A1 Feb. 4, 2010

(30) Foreign Application Priority Data

Nov. 17, 2006 (IT) ..... MO2006A0380
Jan. 22, 2007 (IT) ..... MO2007A0017

(51) Int. Cl.
*B65B 53/00* (2006.01)

(52) U.S. Cl.
USPC ..... 53/556; 53/389.1; 53/389.2; 53/389.4

(58) Field of Classification Search
USPC ..... 53/168, 389.1, 389.2, 389.4, 556, 558
See application file for complete search history.

(56) References Cited

U.S. PATENT DOCUMENTS

| | | | | |
|---|---|---|---|---|
| 4,914,891 | A * | 4/1990 | Suolahti | 53/399 |
| 5,797,240 | A * | 8/1998 | Martin-Cocher et al. | 53/399 |
| 6,553,746 | B1 * | 4/2003 | Cere' | 53/589 |
| 6,772,573 | B2 * | 8/2004 | Federeszyn | 53/389.2 |
| 7,178,317 | B1 * | 2/2007 | Koskela | 53/587 |
| 7,356,976 | B2 * | 4/2008 | Tosa | 53/399 |
| 7,533,515 | B1 * | 5/2009 | Koskela | 53/556 |
| 7,540,128 | B2 * | 6/2009 | Lancaster et al. | 53/556 |
| 7,837,140 | B2 * | 11/2010 | Zitella et al. | 242/559.4 |
| 2003/0145563 | A1 * | 8/2003 | Cere' | 53/588 |
| 2004/0163364 | A1 * | 8/2004 | Cousins et al. | 53/556 |
| 2005/0193687 | A1 | 9/2005 | Tosa | |

FOREIGN PATENT DOCUMENTS

| | | |
|---|---|---|
| EP | 1 097 867 A1 | 5/2001 |
| EP | 1 655 225 A1 | 5/2006 |

* cited by examiner

*Primary Examiner* — Alexandra Elve
*Assistant Examiner* — Eyamindae Jallow
(74) *Attorney, Agent, or Firm* — Laubscher & Laubscher, P.C.

(57) ABSTRACT

An apparatus comprises a reel-holding unit for a wrapping machine for wrapping a product with a film unwound by a plurality of rollers from the reel and a reel-changing unit for replacing a finished reel with a new reel, the reel-holding unit and the reel-changing unit being mutually positionable in a reel-change configuration in such a manner that the new reel can be positioned instead of the finished reel, the reel-changing unit being provided with elements that define a curvilinear path for an initial portion of the film of the new reel, the elements being positionable in the reel-change configuration such that when a roller of the plurality of rollers is positioned at a curve, at least one of the elements is completely interposed between the film and the roller.

29 Claims, 21 Drawing Sheets

Fig. 8A
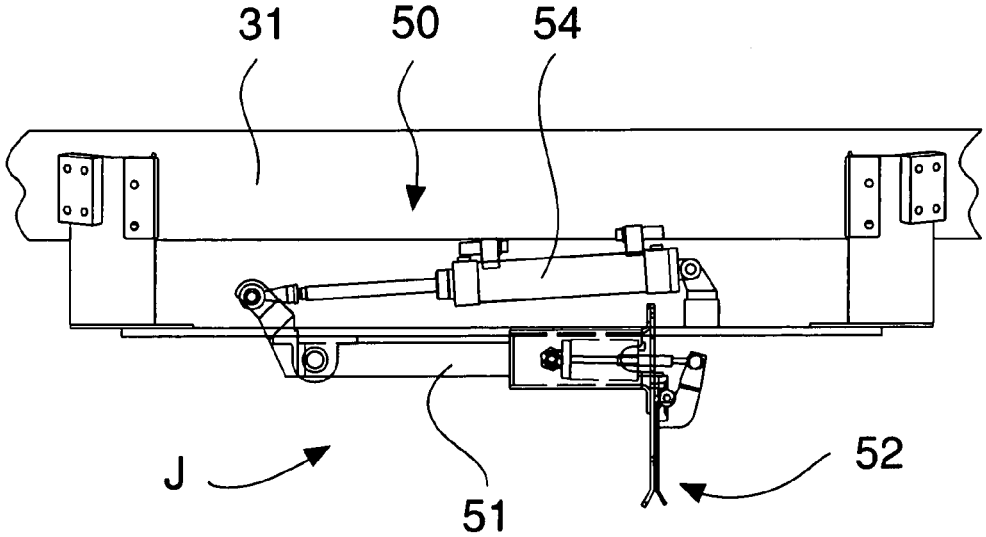
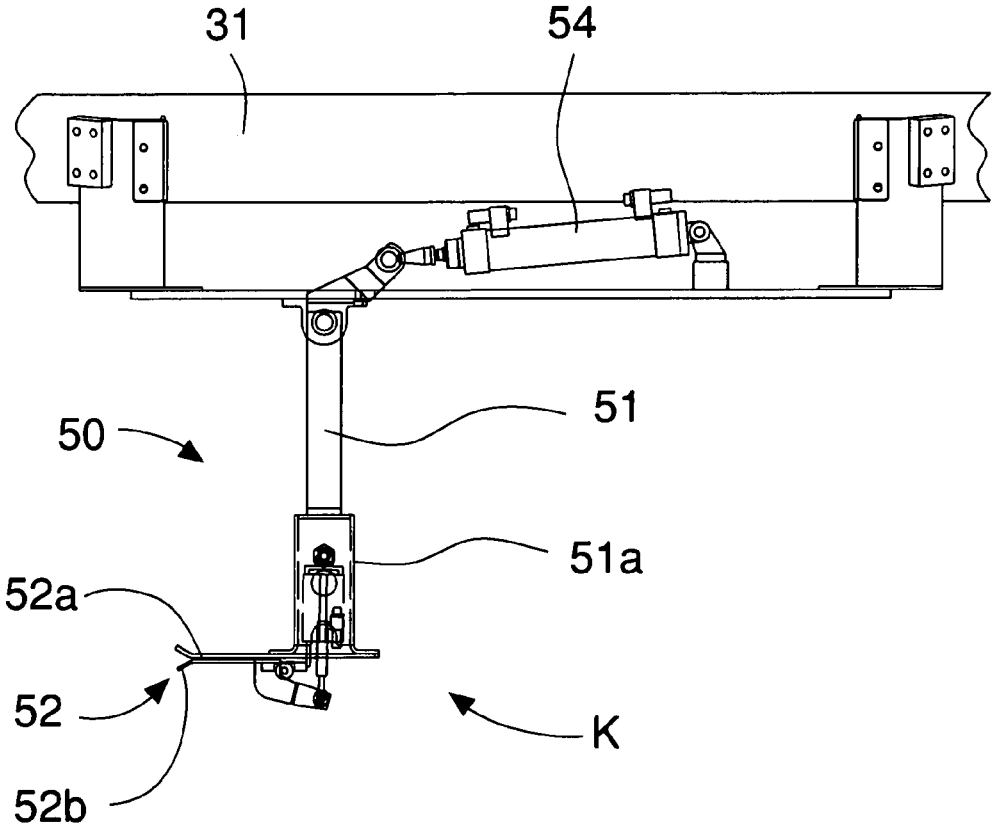
Fig. 8B

V1
24
27
25
26
28
29
10'
Y2
22
3
4
220
Y3
R1
7
67
13a
201
203
L4
6
L3
221
223
222
13
202
13b
V2
200
204
2

APPARATUS FOR CHANGING FILM REELS

This application is a continuation of PCT International Application No. PCT/IB2007/003505 filed Nov. 16, 2007. PCT/IB2007/003505 claims priority to IT Application No. MO2006A000380 filed Nov. 17, 2006 and to IT Application No. MO2007A000017 file Jan. 22, 2007. The entire contents of these applications are incorporated herein by reference.

The invention relates to an apparatus for changing film reels, in particular films made of extendible plastics, automatically in a wrapping machine arranged for wrapping with said film a product or a plurality of products placed on a bed or pallet.

Wrapping machines are known comprising a frame provided with one or two vertical columns suitable for supporting a load-bearing structure, bearing an unwinding unit.

The load-bearing structure, which is movable along a vertical axis, supports a rotating ring rotated around a said vertical axis and arranged for supporting the unwinding unit. In this way, the latter rotates around the product with an alternating movement in a vertical direction, so as to wrap the product with bands of crossed film for the entire height thereof.

The rotating ring is replaced in some machines by a rotating arm rotatably fixed to the frame of the machine and slidably supporting the unwinding unit at a free end.

Wrapping machines are further known in which the unwinding unit is fixed to the load-bearing structure and is the product that is rotated around a vertical axis, by a suitable platform or turntable.

Apart from the various types of wrapping machine, the unwinding unit substantially comprises a supporting element, fixed to the rotating ring or to the structure, to which there are fixed in a rotatable manner a supporting shaft of the reel of film, at least a pair of prestretching rollers, a plurality of deviating or idling rollers, and possibly a roller, a so-called dandy roll, for controlling the unwinding and tensioning of the film.

The film of plastics is unwound from the reel and is suitably wound around the aforesaid rollers according to a curvilinear path that enables the film to be correctly unwound and enables the film to be prestretched or elongated as desired.

In the event of the film being finished, the reel has to be replaced with a new reel. This replacement operation is generally performed manually by one or more operators who, after stopping the machine and positioning the unwinding unit at a suitable height from the ground, remove the finished reel from the corresponding supporting shaft, and then insert and block the new reel of film.

At this point it is necessary to remove from the new reel an initial portion of the film and wind the film around prestretching and idling rollers according to the winding curvilinear path required, as far as a grasping gripper fixed to the load-bearing structure and intended to retain the film in the initial step of wrapping around the product. This plurality of manual interventions are not only tiring for the operator but are also extremely slow and require long periods of machine downtime, with a noticeable reduction in machine productivity.

In order to overcome this drawback, apparatuses are known for changing reels comprising a carriage bearing one or more new reels and which is movable away or towards the machine. During replacement of the reel, the carriage is near the machine to receive the finished reel and to release the new reel, which is inserted into the supporting shaft of the unwinding unit automatically.

In some machines, together with the reel the corresponding supporting shaft is replaced, as suitable seats are provided on the unwinding unit that are suitable for supporting the shaft and at the same time enabling said shaft to be extracted and inserted.

In this way the reel can be replaced automatically, nevertheless it is necessary to wind manually the initial edge of film around the rollers of the unwinding unit. This operation is laborious and slow, and increases the time that is necessary for replacing the reel.

In order to overcome this drawback, unwinding units are known that are provided with a plurality of tensioning rollers movable between an opening position and a closing position.

In the opening position these tensioning rollers enable an initial edge of the film of the reel to be unwound, positioned above the prestretching and idling rollers until it is blocked at a stop gripper. In the closing position the tensioning rollers are inserted between said prestretching and idling rollers, tensioning the film between the reel and stop gripper and making the required unwinding curvilinear path of the film.

A drawback of such apparatuses lies in the fact that it is necessary to stop the machine at least for the time required to unwind the initial edge of film, fix the film to the arrest gripper, and open and close the tensioning rollers in position.

In addition thereto, the latter and the corresponding supporting and moving arrangement make the unwinding unit more complex and therefore costly, which is further more cumbersome and heavier.

European patent demand EP 1655225 discloses an apparatus for changing film reels in a wrapping machine, comprising a movable carriage moving towards/and or away from the machine on which they are mounted, in addition to the reel of new film, a plurality of sleeves or hollow cylinders around which an initial edge of the film is wound by an operator. This edge is locked in an extended position by an arrest gripper fixed to the carriage. The sleeves are dimensions and arranged so as to receive respective prestretching and idling rollers of the unwinding unit, when the latter is lowered onto the carriage that is movable in a reel-change configuration.

In this way, by means of a plate provided with teeth that are insertible into respective grooves of the sleeves, it is possible to move the film from the latter to the prestretching and idling rollers.

This apparatus, which enables the initial edge of film of the new reel to be wound around the prestretching and idling rollers in a relatively short time and without the need for movable tensioning rollers mounted on the unwinding unit, nevertheless has some drawbacks.

A first drawback consists of the need to position the unwinding unit with extreme precision in order to enable the prestretching and idling rollers to become inserted into the respective sleeves without colliding with the edges of the latter. This positioning is particularly delicate and complex, especially in the case of wrapping machines with a rotating ring, due to the play and dimensional tolerance in machines of such dimensions and which generally increase over time and with use.

Safety sensors have to be provided to block the descent of the unwinding unit and prevent damage to the latter and/or to the machine if even one roller is not aligned with the respective sleeve. If this occurs, it is necessary to stop the machine, check the fixing of the rollers and sleeves and check a driving device and positioning of the rotating ring, with a consequent increase in costs and decrease of productivity.

A further drawback of this apparatus consists of the fact that the film of plastics tends to adhere to the external surface of the sleeves on which it is wound, thus making lifting and moving thereof onto the rollers of the unwinding unit by the transferring plate difficult. The teeth of the plate, engaging in the corresponding grooves of the sleeves, during lifting may also not be able to move the film, or cause cuts and/or lacerations thereupon that compromise the correct winding thereof on the prestretching and idling rollers.

Still another drawback of the aforesaid apparatus is the need to rotate the prestretching rollers to partially rewind and tension films to prevent the film being able to unwind during lifting of the unwinding unit due to the difference in the diameter of said rollers and the sleeves. This operation is laborious and delicate and carries the concrete risk of enabling the film to unwind from one or more rollers and/or of leading to breakage of the film.

Another drawback of known apparatuses for automatic changing of a reel lies in the complexity and therefore the cost of a removing arrangement arranged for grasping and extracting a finished reel from the supporting shaft of the unwinding unit.

Such known removing means arrangement comprises, for example, a movable arm that is provided with a gripping device that is able to grasp the finished reel, remove the finished reel from the shaft and move it outside the wrapping machine. Such a movable arm, which requires a plurality of actuators and a control device to perform the sequences of movements necessary for replacing the reel, is generally very costly.

In European patent application EP 1655225 a reel change apparatus is provided comprising a fixed pin mounted on the movable carriage and suitable for receiving the finished reel unhooked and removed from the supporting shaft of the unwinding unit by means of a suitable unhooking and extracting arrangement.

During operation, the supporting shaft is arranged coaxially to the fixed pin and the unhooking and extracting arrangement is driven to transfer the reel to said pin.

A drawback of this apparatus consists of the fact that the unhooking and extracting arrangement that respectively comprises stopping jaws and pushing elements is driven by a pneumatic actuator by means of transmission and kinematic mechanisms such as levers, tie rods, cams that are very complex that in addition to being costly to produce and assemble may be subject to malfunctions.

In addition to this, as the unhooking and extracting arrangement and part of these transmission and kinematic mechanisms are mounted on the supporting shaft, the unwinding unit is more cumbersome and heavy.

Apparatus are known for changing reels comprising a plurality of reel-holding carriages that are suitably moved towards and away from a respective wrapping machine for performing a plurality of reel changes automatically, in order to maintain almost continuous operation of the machine and/or not to require constant intervention by an operator. For this purpose said carriages are fitted on linear guides that are generally arranged longitudinally, adjacent to the wrapping machine, to enable each carriage to be arranged in a reel-change operating position. Further transverse linear guides are sometimes provided that enable each single carriage to be moved towards or away from the machine, thus preventing cumbersome longitudinal guides being placed next to the machine.

Apparatuses are further known comprising a carriage that is movable linearly away from/towards the wrapping machine provided with a plurality of new reels, mounted on a carousel or rotatable support and which by rotating places each reel in the reel-change operating position.

A drawback of such apparatuses consists of the encumbrance of the moving means and devices of the carriages which, arranged adjacent to the wrapping machine, limit accessibility to the latter and to the carriages. These moving devices, which comprise linear sliding guides, actuators, position sensors, transferring arrangement, etc, are further generally complex and costly, and require suitable control and management systems for commanding and coordinating the operation thereof.

An object of the invention is to improve known apparatuses for changing film reels in a wrapping machine, in particular by increasing simplicity and versatility of use.

Another object is to devise an apparatus that enables a finished reel of film to be replaced substantially automatically with a new reel in a wrapping machine, with minimum manual interventions and in a relatively rapid time.

A further object is to obtain an apparatus that is able to set up in an optimal manner an initial portion of film of a new reel and to enable a rapid and safe transfer onto rollers of a reel-holding unit of the wrapping machine.

Still another object is to devise an apparatus that does not require particularly precise positioning of the reel-holding unit of the wrapping machine to enable the finished reel to be replaced, and in particular a new reel to be picked up and the corresponding initial portion of film to be wound on the rollers.

A still further object is to obtain an apparatus that enables an initial portion of film to be unwound and tensioned on the rollers of the reel-holding unit without the need to rotate the latter.

Still another object is to obtain an apparatus that enables a finished reel to be both detached and extracted from the reel-holding unit, and a new reel to be inserted and locked on the reel-holding unit in a rapid, simple and effective manner.

Another further object is to make an apparatus having limited overall dimensions and a structure that is compact, simple and cheap to make.

In a first aspect of the invention there is provided an apparatus comprising a reel-holding unit for a wrapping machine for wrapping a product with a film unwound by a plurality of rollers from said reel and a reel-changing unit for replacing a finished reel with a new reel, said reel-holding unit and said reel-changing unit being mutually positionable in a reel-change configuration in such a manner that said new reel can be positioned instead of said finished reel, said reel-changing unit being provided with elements that define a curvilinear path for an initial portion of said film of said new reel, wherein said elements are positionable in said reel-change configuration such that when a roller of said plurality of rollers is positioned at a curve, at least one of said elements is completely interposed between said film and said roller.

The elements are further movable, between a work position, in which they are completely interposed between said film and said roller, and a disengagement position, in which they are not interposed between said film and said roller to enable said film to wound on said roller.

Owing to this aspect of the invention it is possible to transfer in a rapid and easy manner a new reel of film and a corresponding properly unwound initial portion, onto a reel-holding unit of a wrapping machine, without the need for the operator to intervene. The elements on which the initial portion of film has been previously wound define, in fact, a winding curvilinear path provided with curves into which the rollers of the reel-holding unit can be inserted at the reel change procedure.

A movable gripping device of an edge of said initial portion enables the film to be wound automatically around the elements and, at the same time maintains said film tensioned to avoid possible detachments from the rollers during the transfer.

This enables the elements to be maintained, interposed entirely between the film and rollers, relatively spaced by the rollers, avoiding the need to position the reel-holding unit and/or the reel-changing unit in a precise and accurate manner. Further, it is not necessary to rotate the rollers to tension the initial portion of film.

The reel-changing unit also comprises a supporting arrangement for supporting the new reel and of elements, which are mounted movably so as to enable the reel and/or the elements to be moved in the case of contact of said reel and/or of said elements with the reel-holding unit.

It is thus possible, in a simple and effective manner, to preserve the apparatus and the wrapping machine from breakages and damage following errors or positioning imprecisions of the reel-holding unit and/or of the reel-changing unit. In the event of a collision, for example, of a supporting shaft of the reel-holding unit with the new reel arranged on the supporting arrangement of the reel-changing unit, said supporting arrangement for example rotating to enable the reel to be lowered, thereby avoiding a stiff shock. By virtue of the presence of a suitable elastic element, said rotation in fact occurs elastically so as to enable the shock to be absorbed. A sensor is provided for detecting the rotation or lowering undergone by the supporting arrangement and generating a corresponding alarm signal for a control unit of the wrapping machine so as to cause the immediate arrest thereof. This prevents the lowering movement of the reel-holding unit continuing and being able to cause damage and breakages.

In a second aspect of the invention there is provided an apparatus comprising a reel-holding unit for a wrapping machine for wrapping a product with a film unwound from said reel and a reel-changing unit for replacing a finished reel with a new reel, said reel-holding unit and said reel-changing unit being mutually positionable in a reel-change configuration in such a manner that said new reel can be positioned instead of said finished reel, said reel-changing unit being movable between a first operating position, wherein said reel-holding unit is spaced from said wrapping machine, and a second operating position, wherein said reel-holding unit is adjacent to said wrapping machine in said reel-change configuration, wherein said reel-changing unit is rotatable between said operating positions around a respective axis.

Owing to this aspect of the invention, it is possible to make an apparatus provided with at least a reel-changing unit associated with the wrapping machine so as to simplify the movements of approaching and or moving away from the latter and, thus, the devices necessary for moving the latter. Owing to the rotatable connection with a frame of the wrapping machine, longitudinal and/or transverse linear sliding guides are not necessary for rectilinear movement of the unit. This enables the total dimensions of the machine to be reduced and a pair of reel-changing units to be inserted on the same operating side of said machine.

In a third aspect of the invention there is provided an apparatus comprising a reel-holding unit for a wrapping machine for wrapping a product with a film unwound from said reel supported by a supporting shaft, and a blocking device associated with said supporting shaft for constraining to said supporting shaft said reel, wherein said blocking device comprises a lever and a pin, said pin being interposed between, and engaged with, said lever so as to enable said lever to be arranged selectively in a supporting operating position, wherein said lever constrains said reel to said supporting shaft, or in an extraction operating position, wherein said lever enables a finished reel to be extracted from said supporting shaft.

Owing to this aspect of the invention, it is possible to obtain an apparatus that enables a reel of film to be constrained reversibly to a supporting shaft of a reel-holding unit, in a simple and effective way without requiring means devices, such as actuators and complex and cumbersome transmission and motion mechanisms.

The lever controlled by the pin by means of coupling between respective contact portions can in fact assume various operating positions, respectively for supporting and locking the reel on the supporting shaft, to enable a finished or new reel to be extracted from or inserted into said supporting shaft.

The invention can be better understood and implemented with reference to the attached drawings that illustrate some embodiments thereof by way of non-limitative embodiment, in which.

Figure 1A:
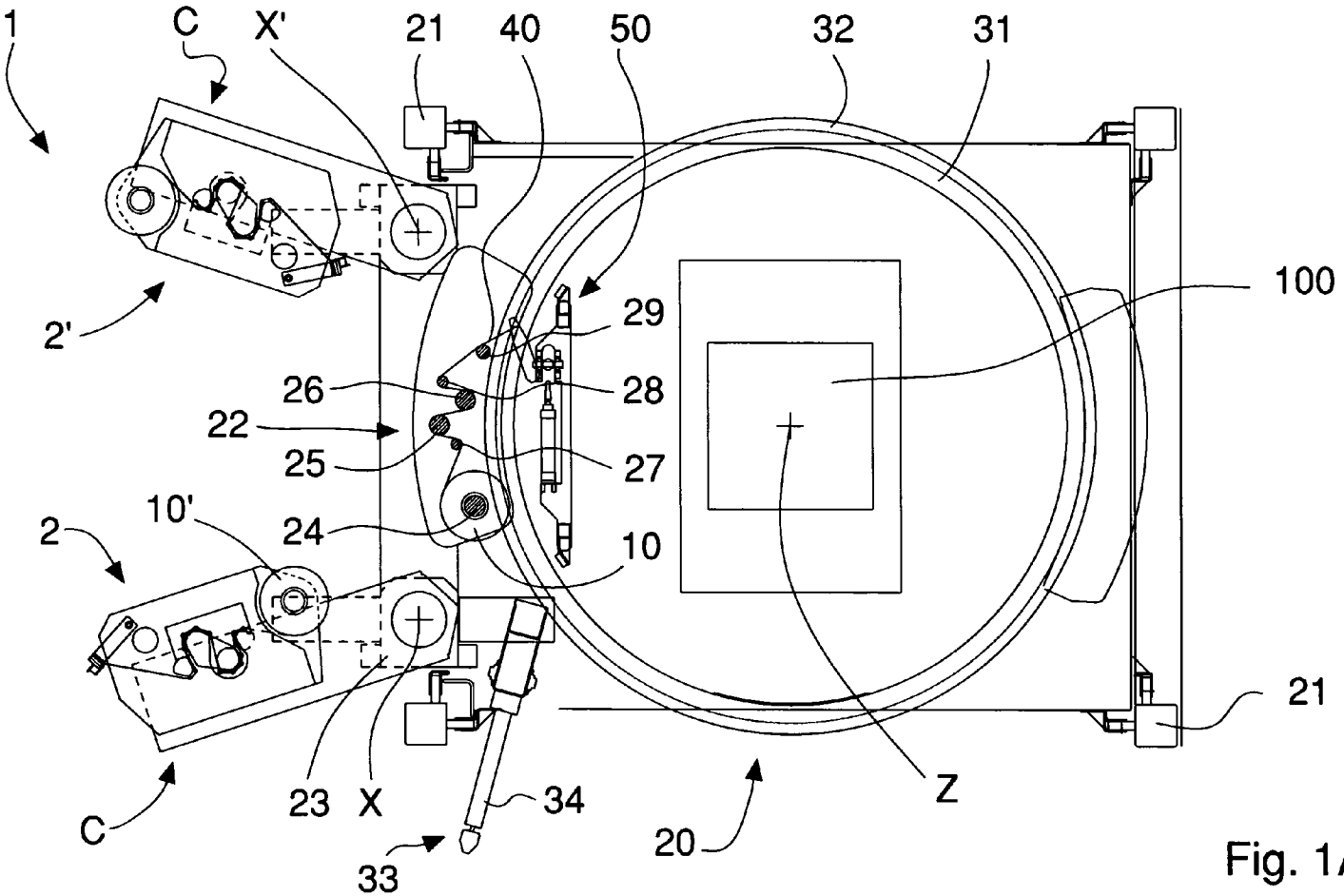
FIG. 1A is a schematic plan view of the apparatus of the invention associated with a wrapping machine, showing two reel-changing units in a first operating position.
Figure 3A:
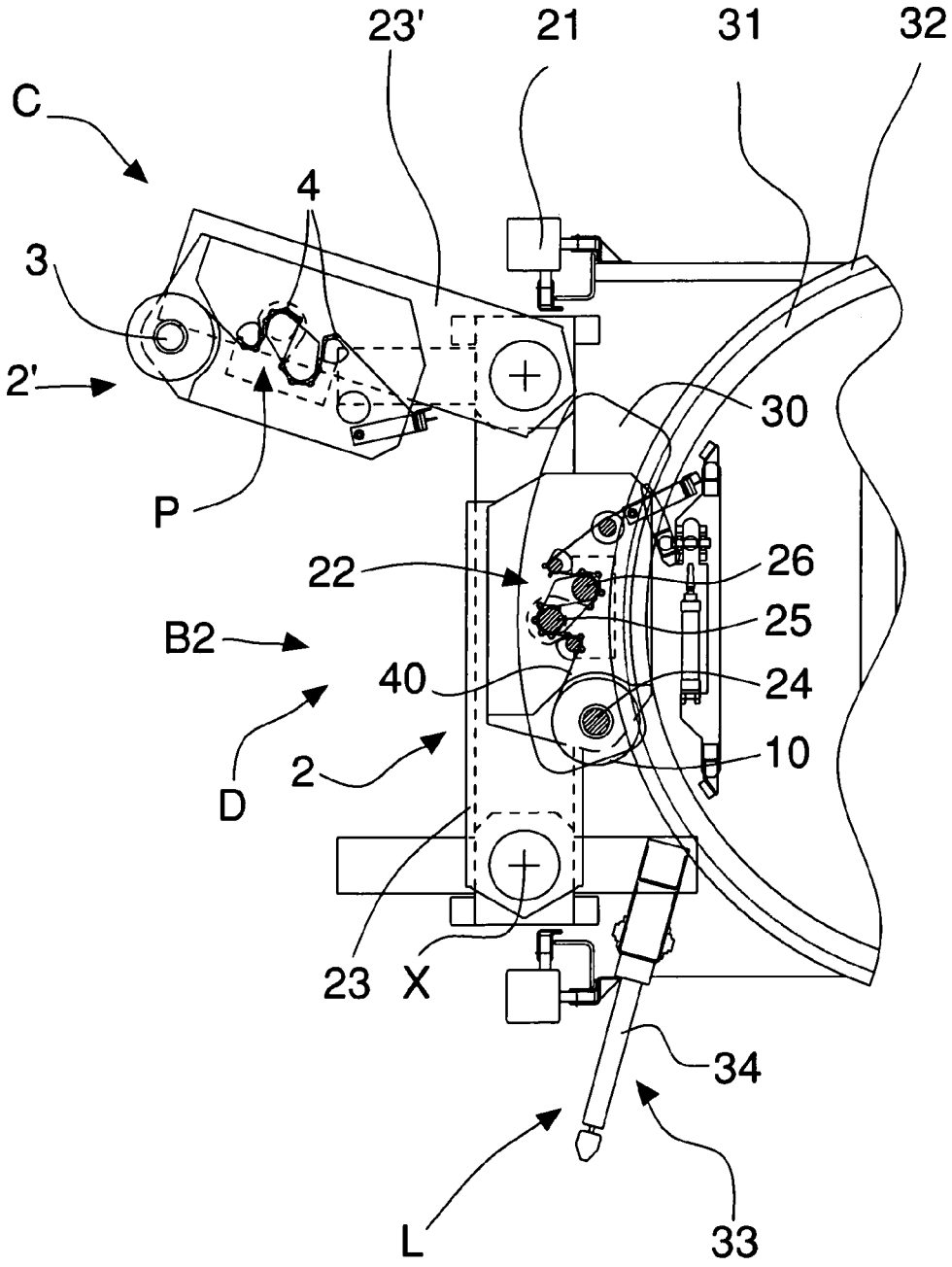
Figure 3C:
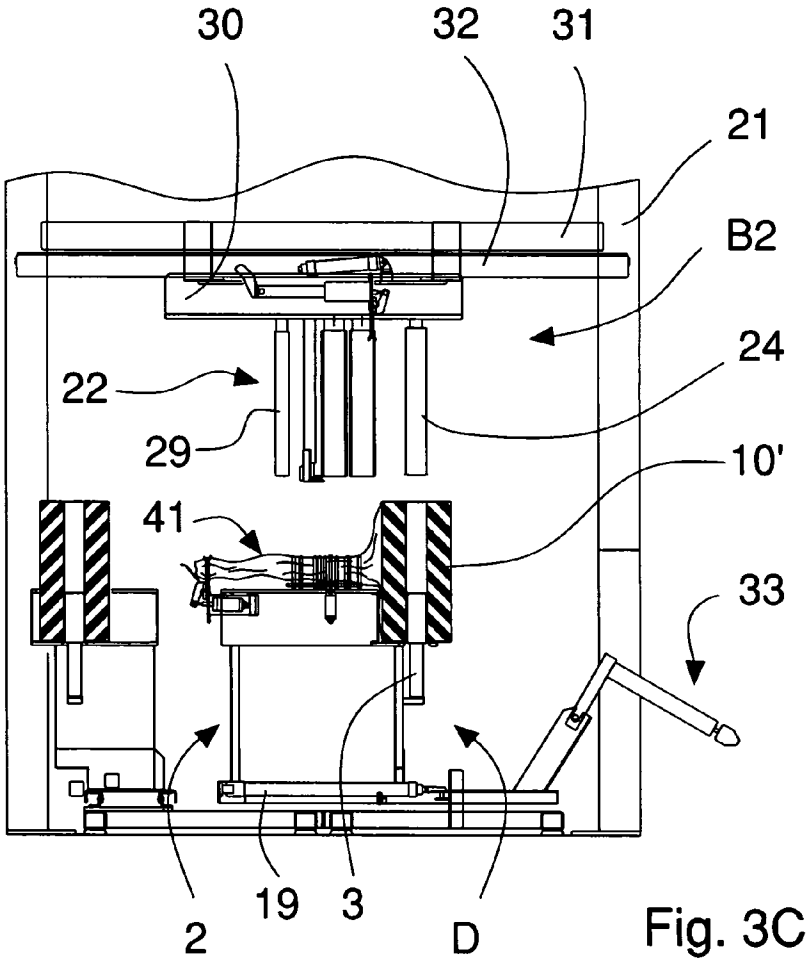
Figure 3B:
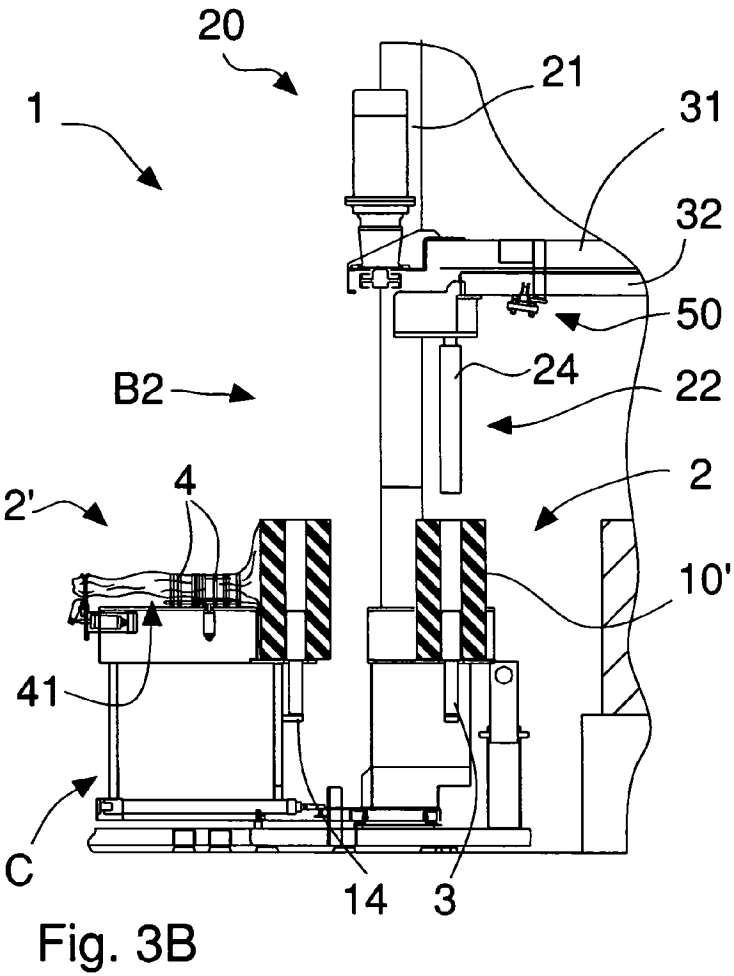
Figure 4B:
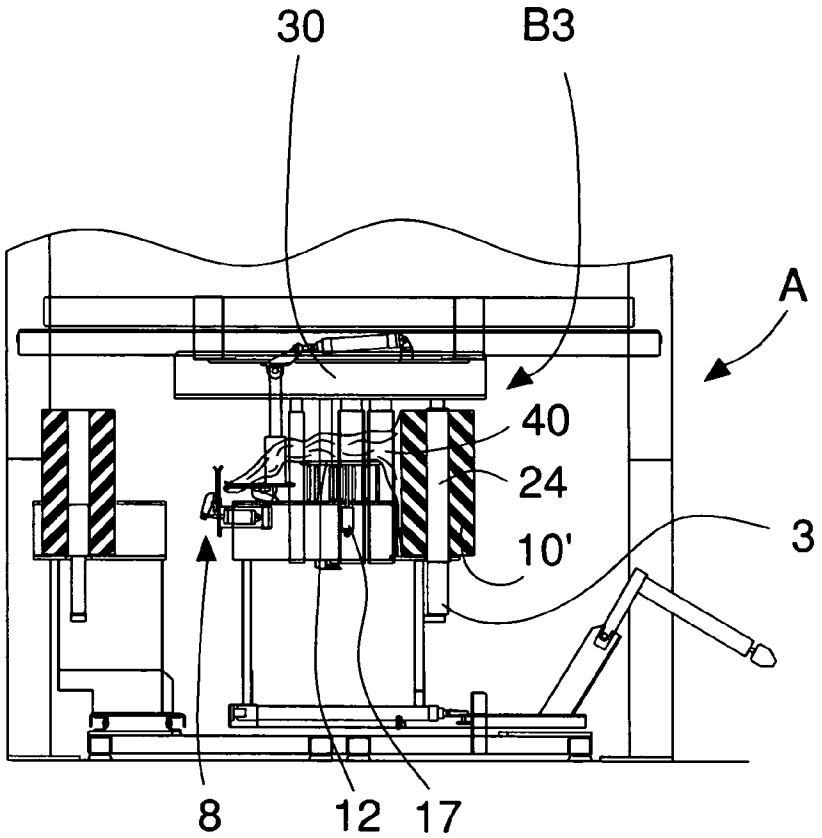
Figure 4A:
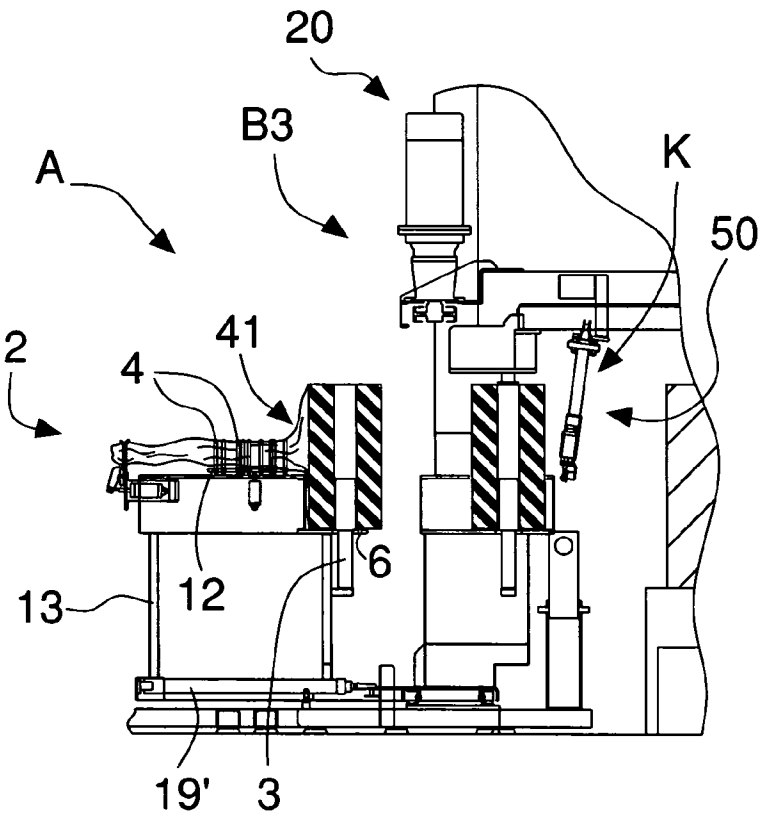
Figure 5B:
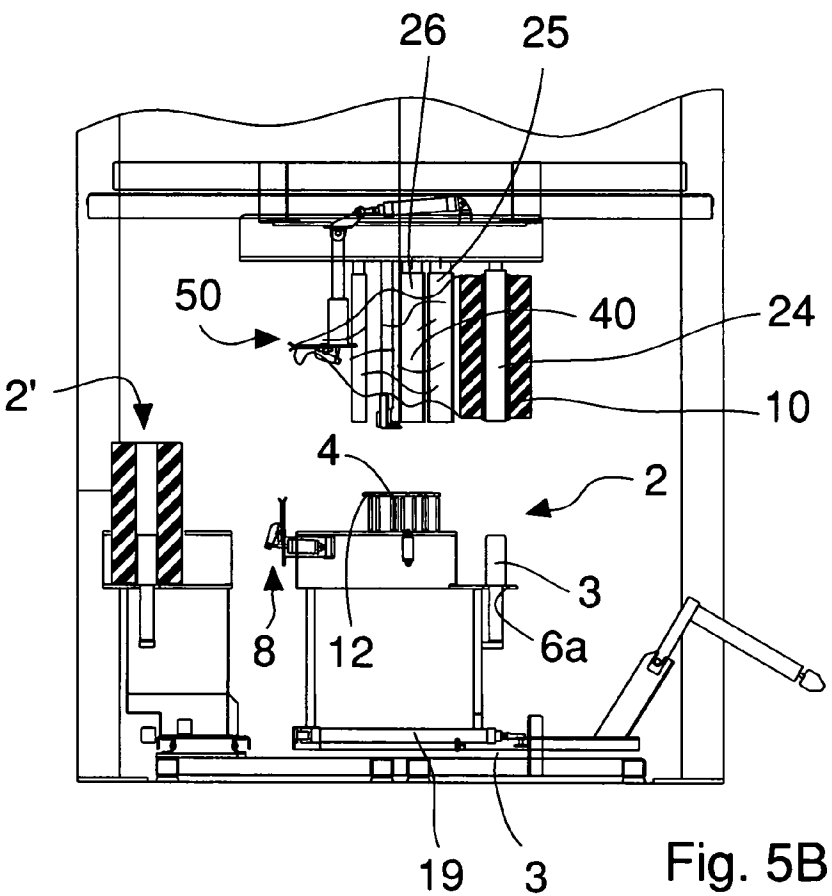
Figure 5A:
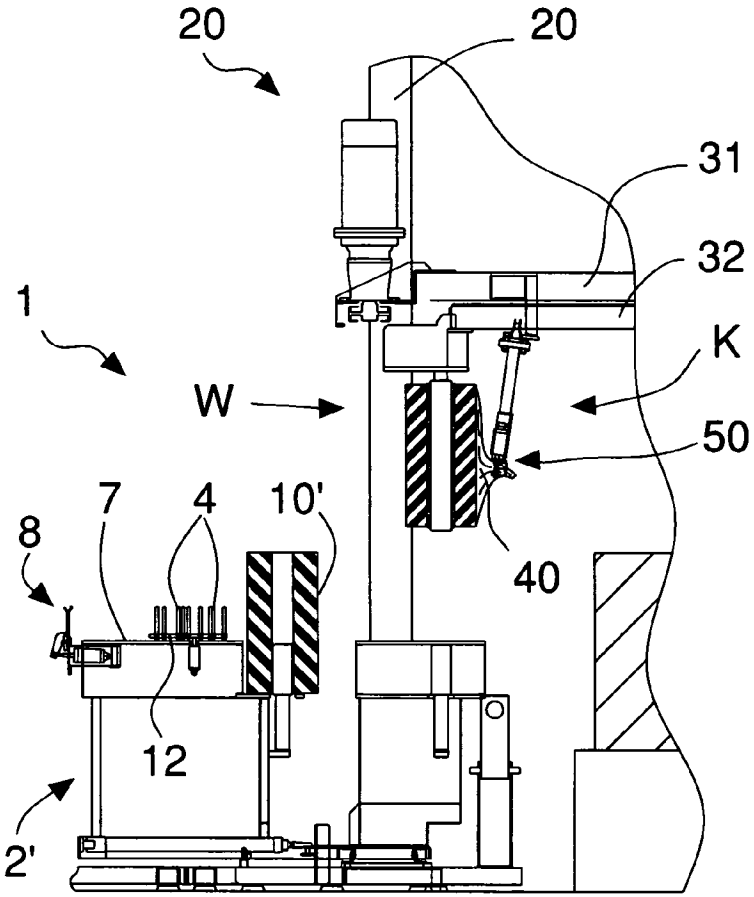
Figure 6A:
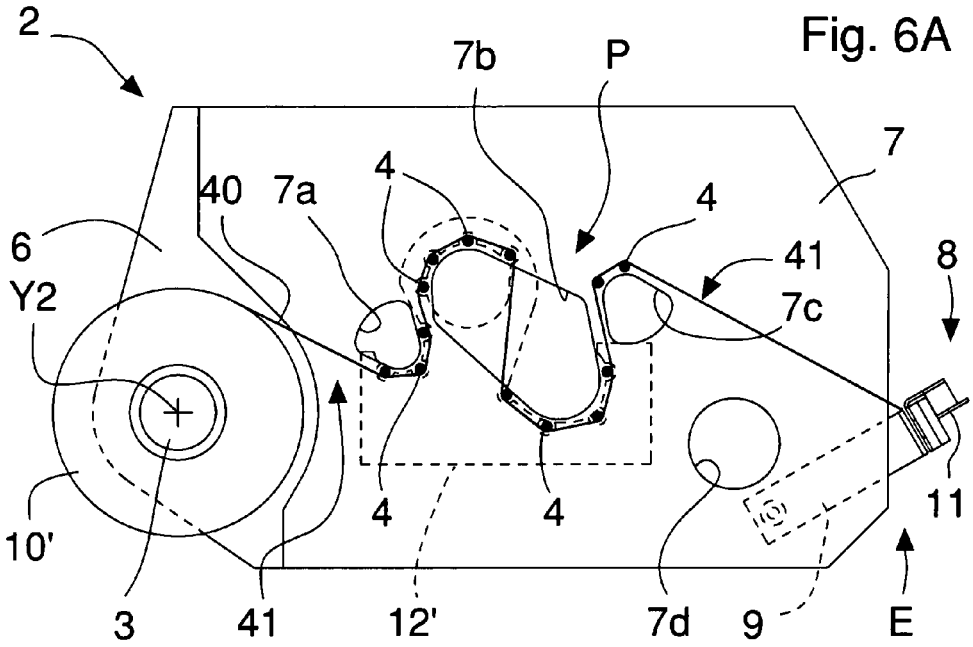
Figure 6B:
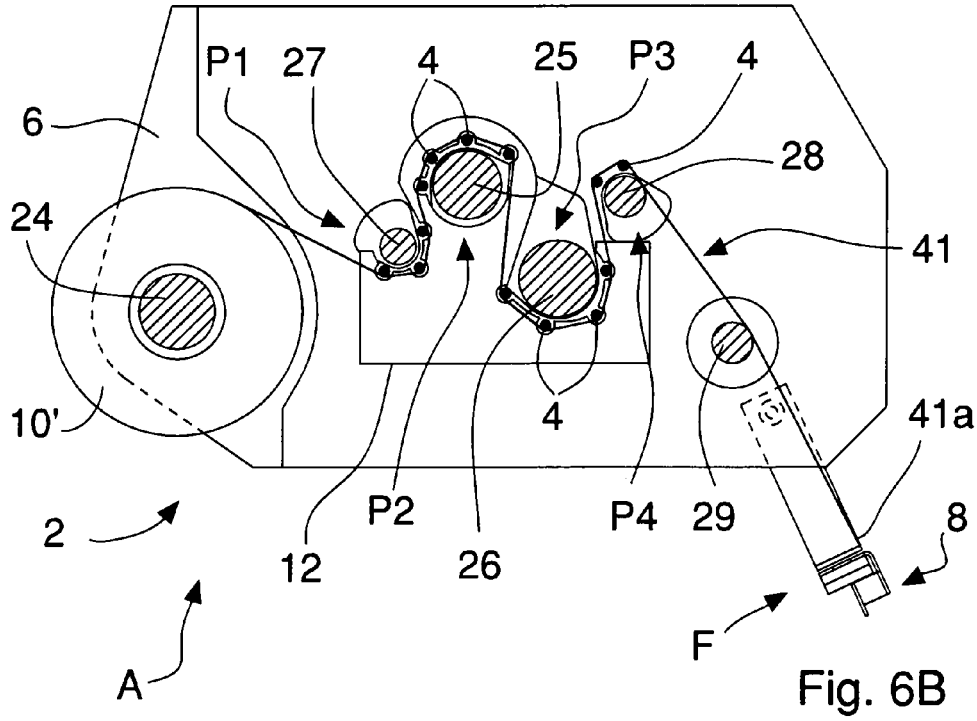
Figure 7:
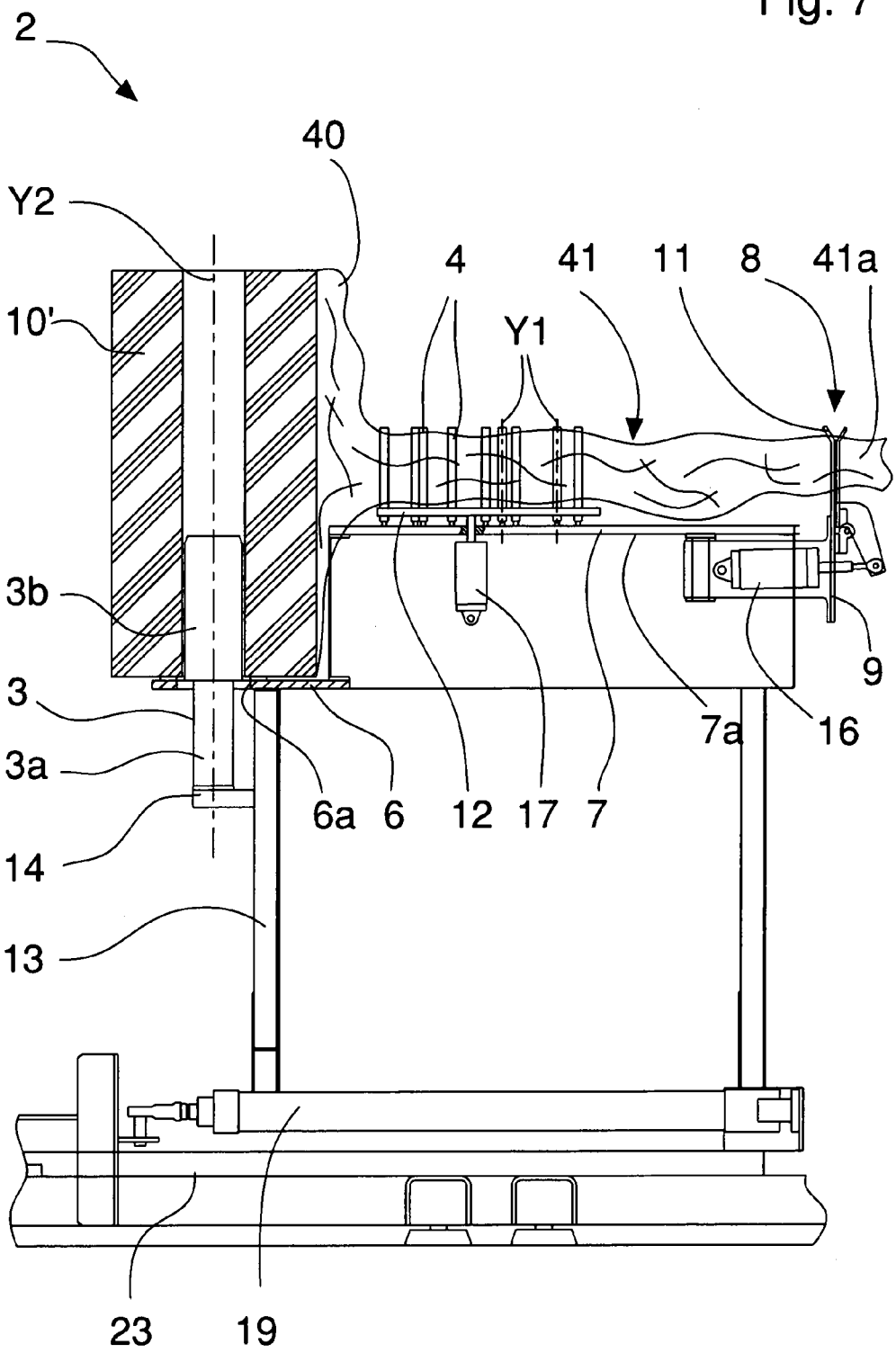
Figure 9:
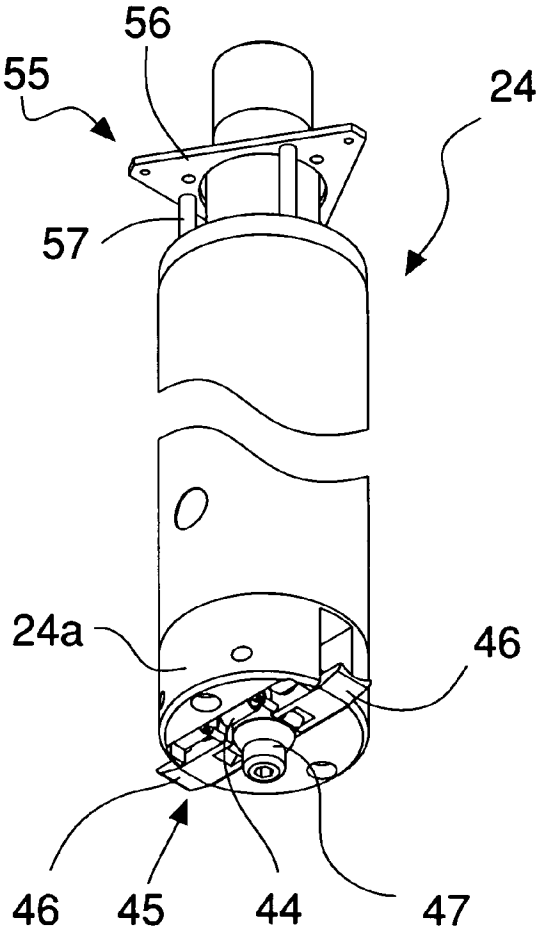
Figure 10:
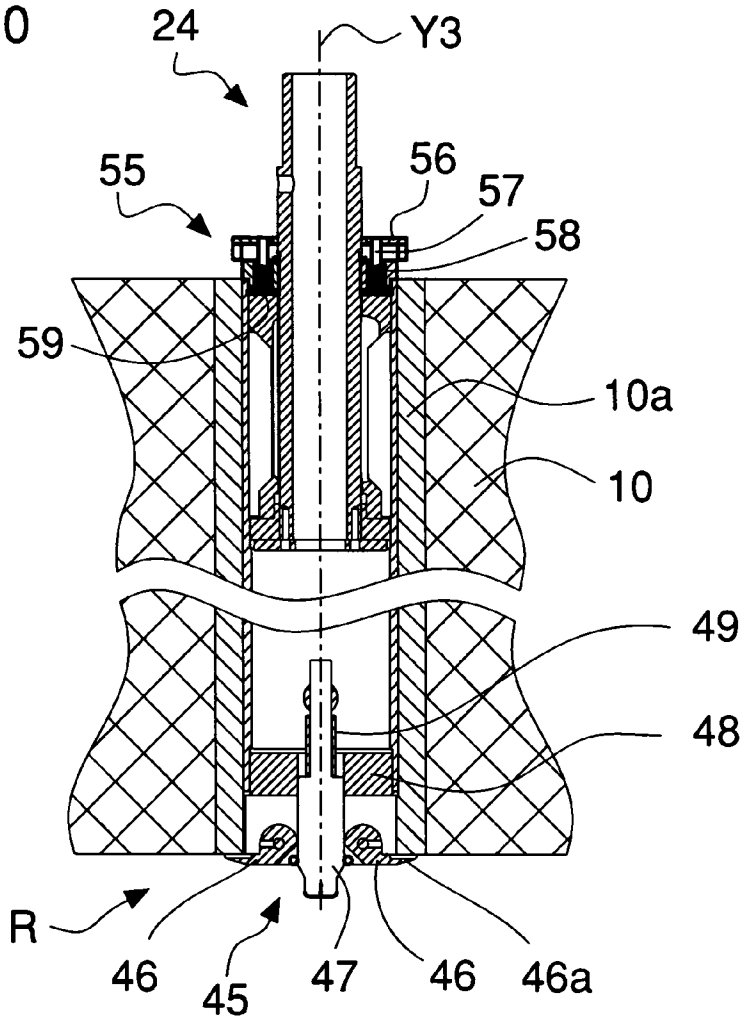
Figure 11A:
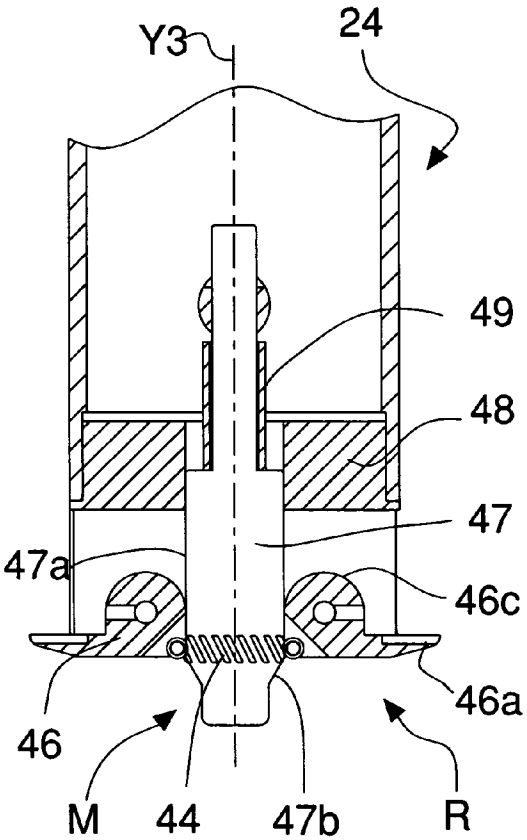
Figure 11B:
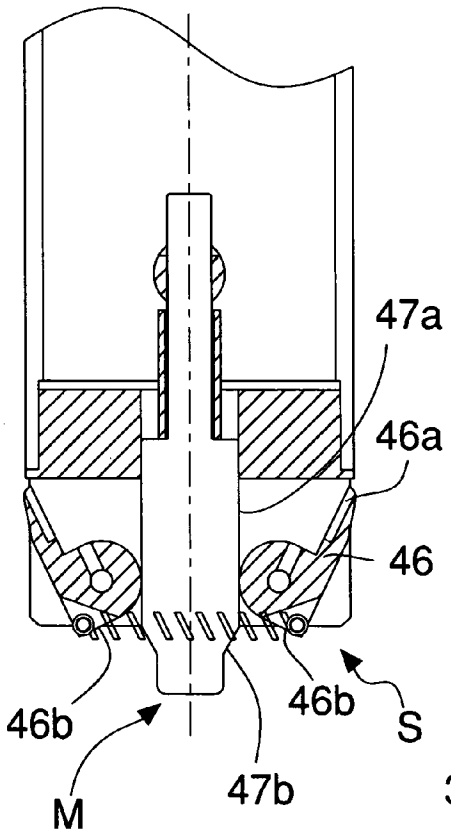
Figure 11C:
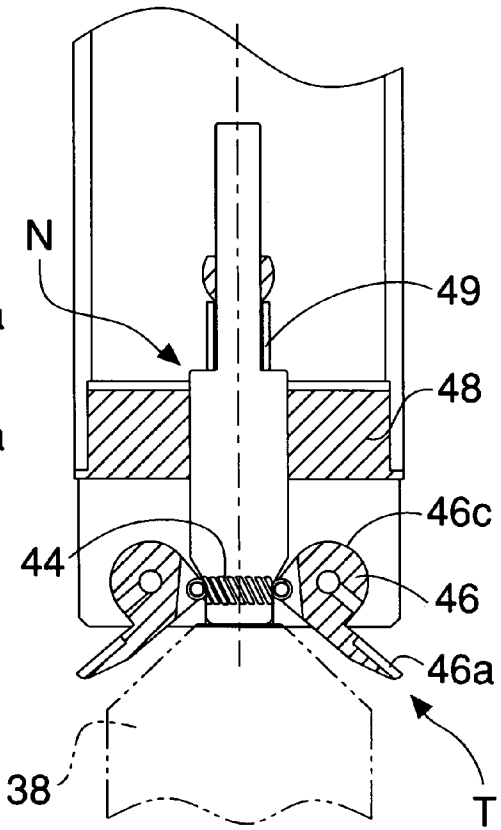
Figure 12:
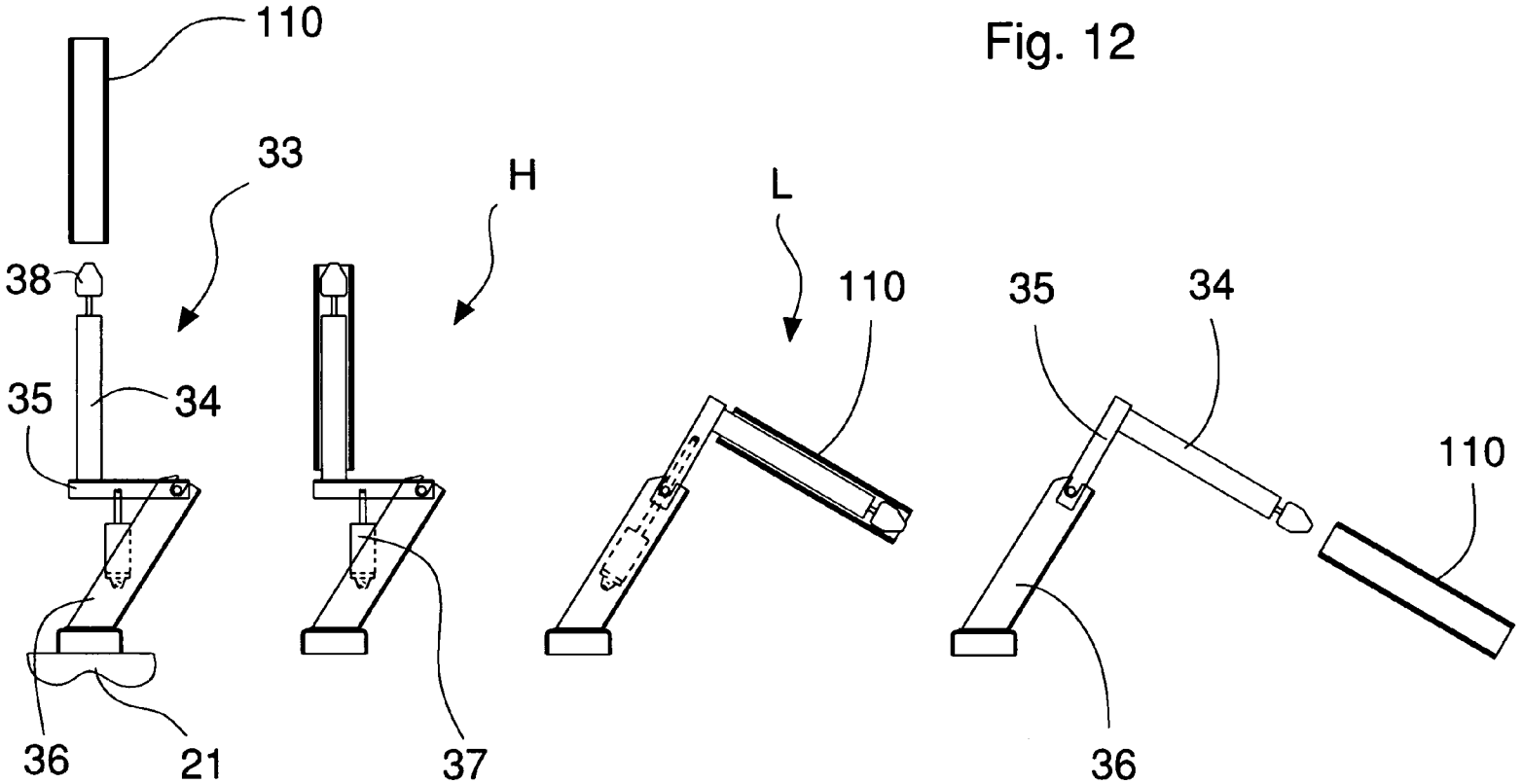
Figure 13A:
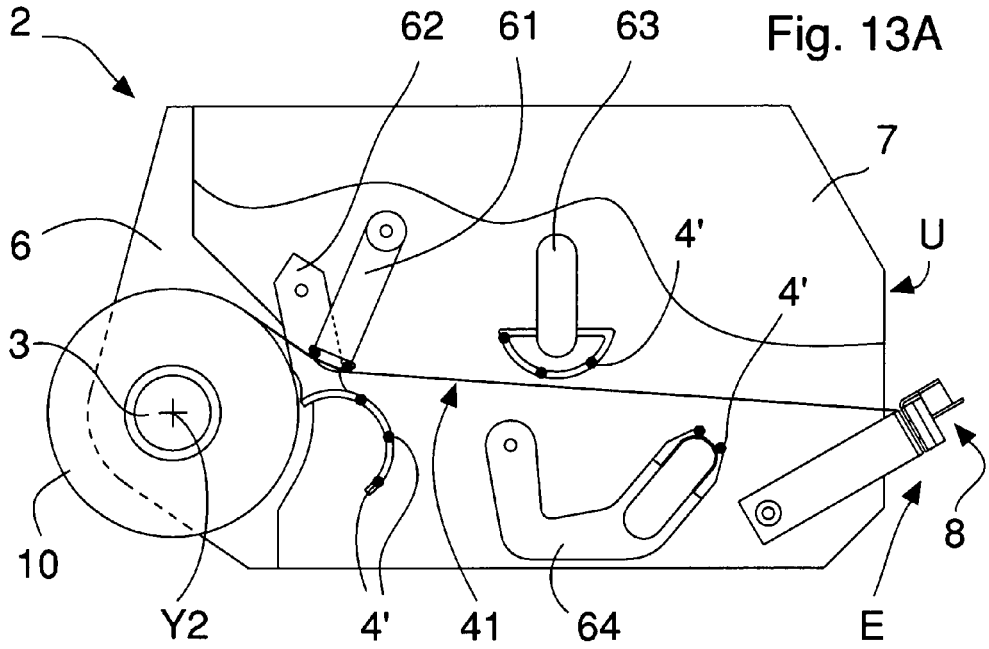
Figure 13B:
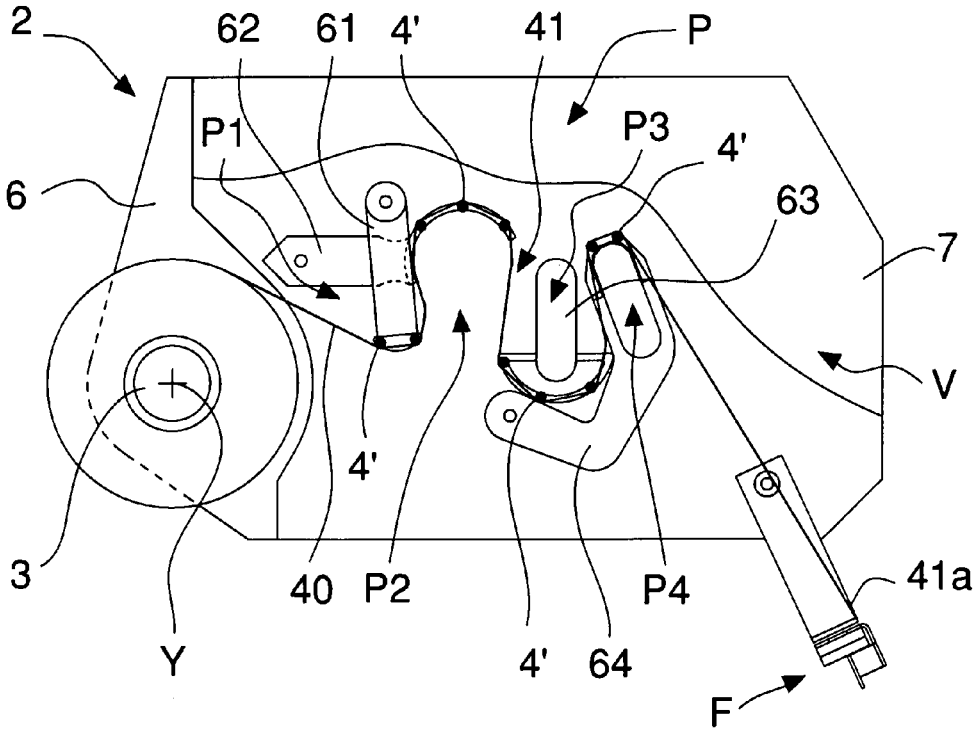
Figure 15:
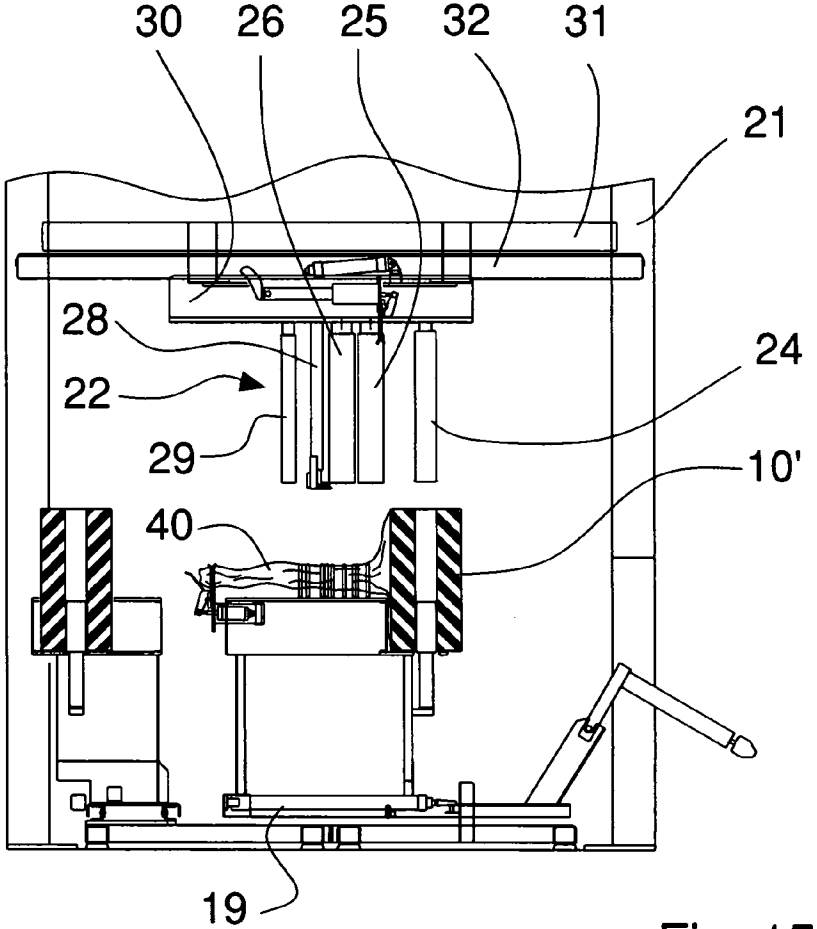
Figure 14:
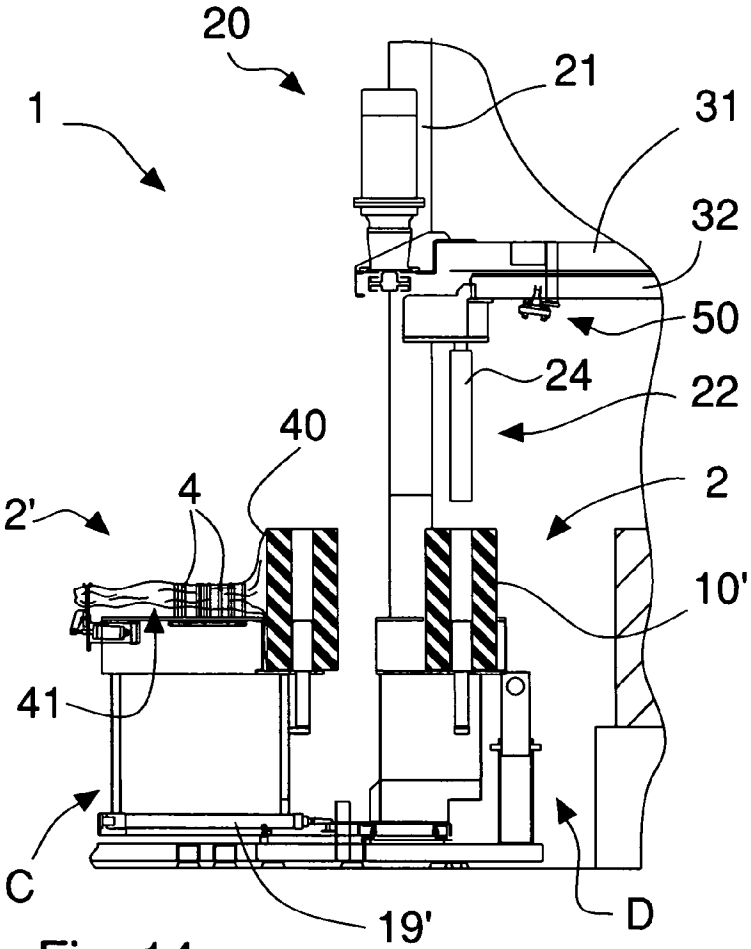
Figure 17:
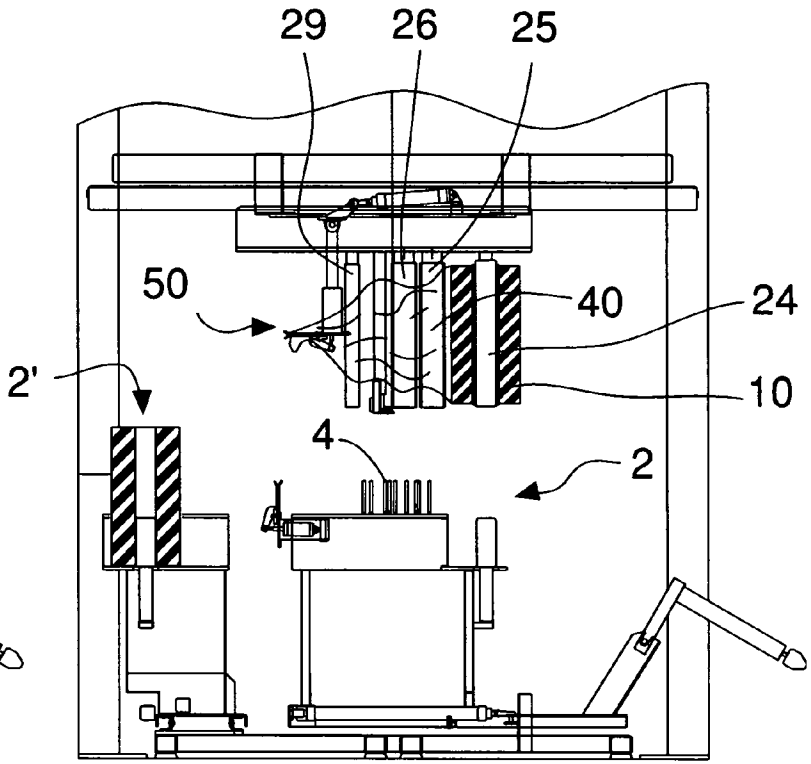
Figure 16:
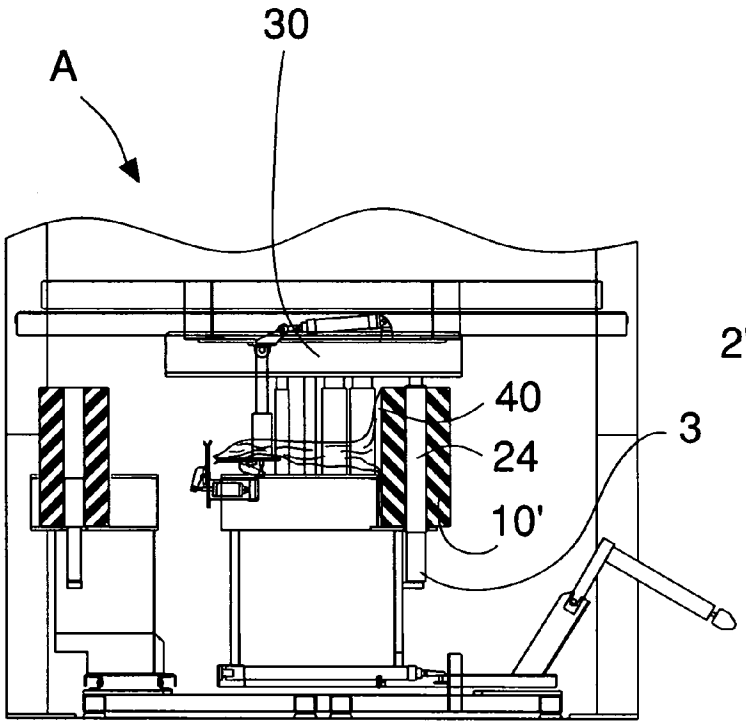
Figure 18A:
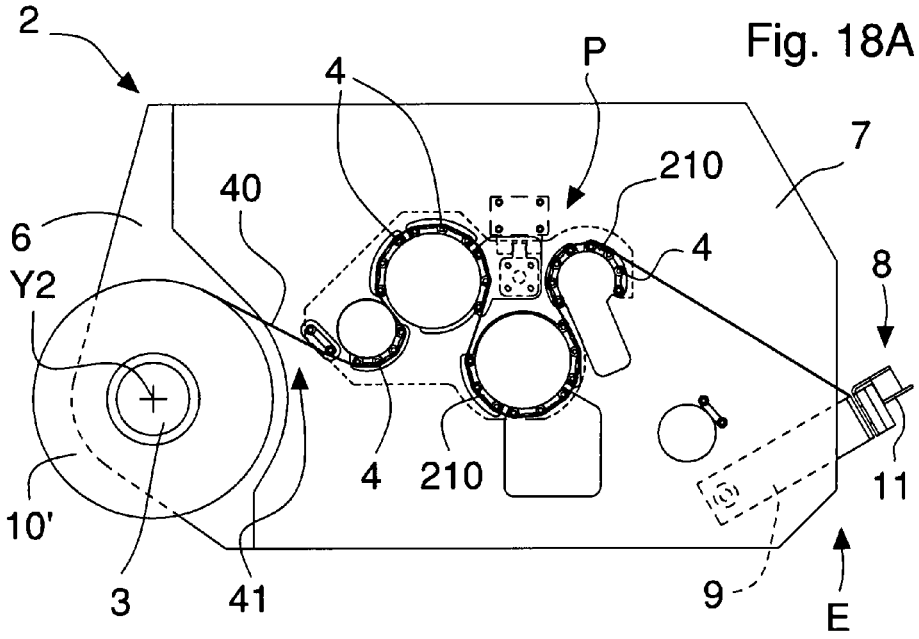
Figure 18B:
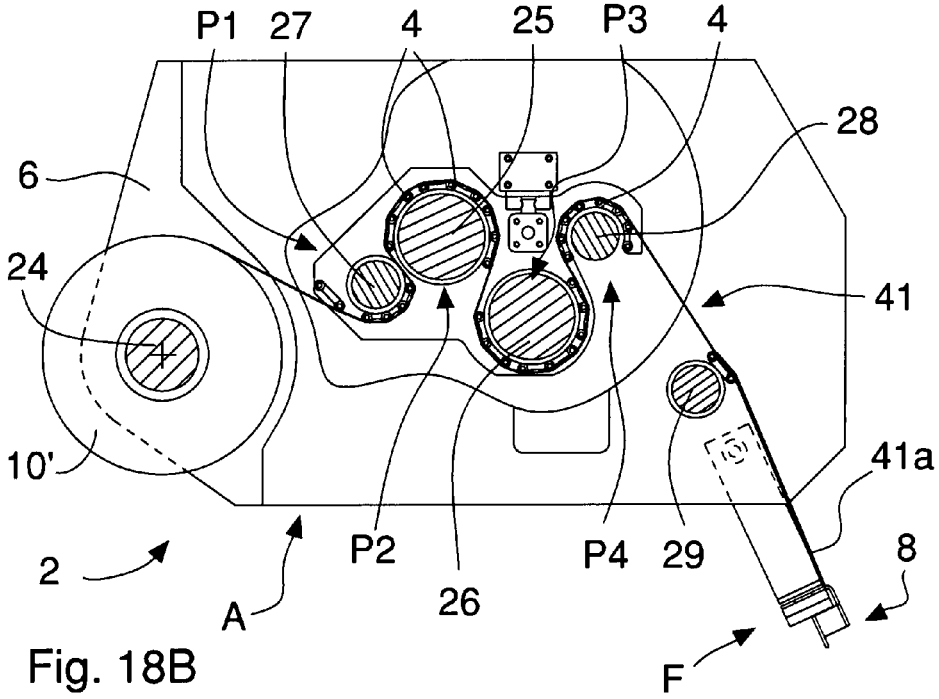
Figure 20:
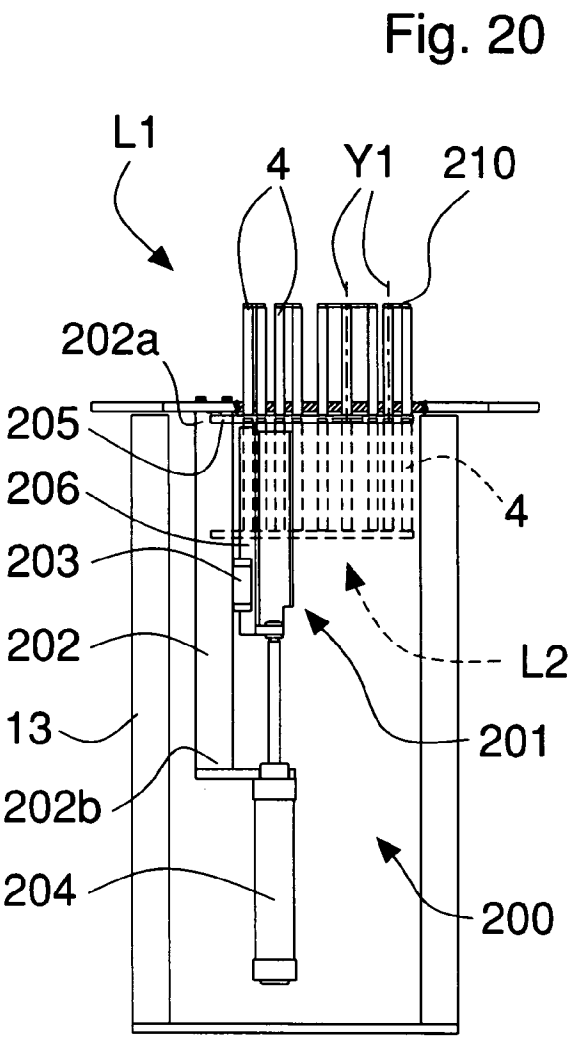
Figure 19:
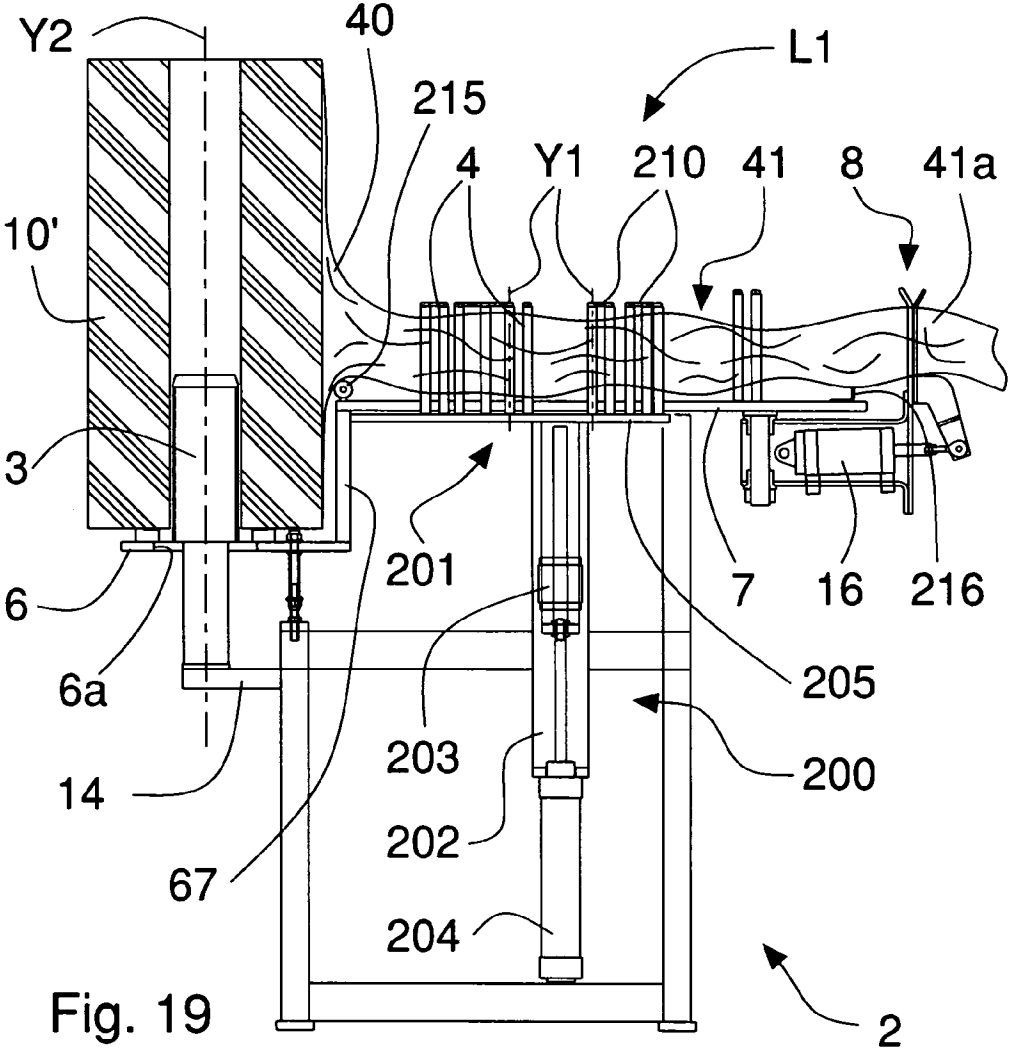
Figure 21A:
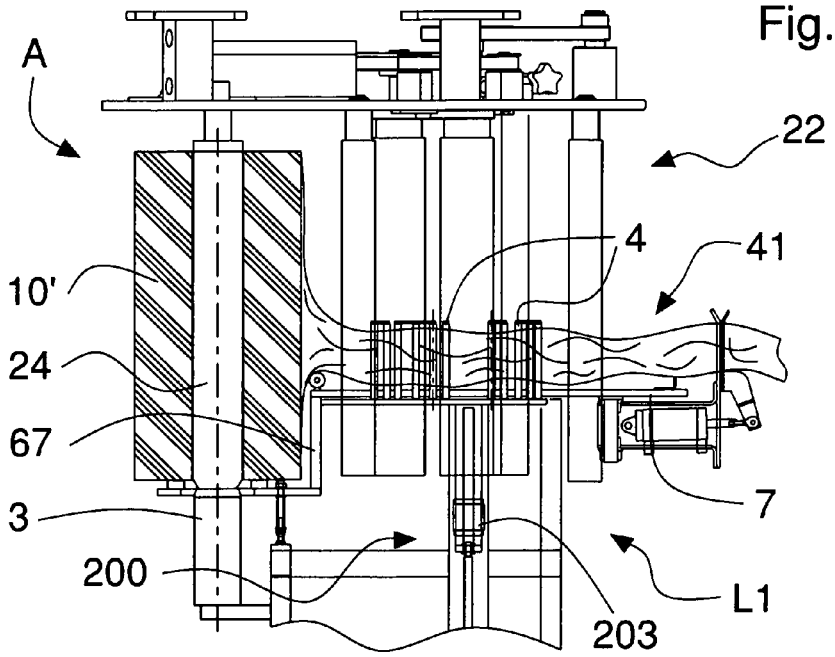
Figure 21B:
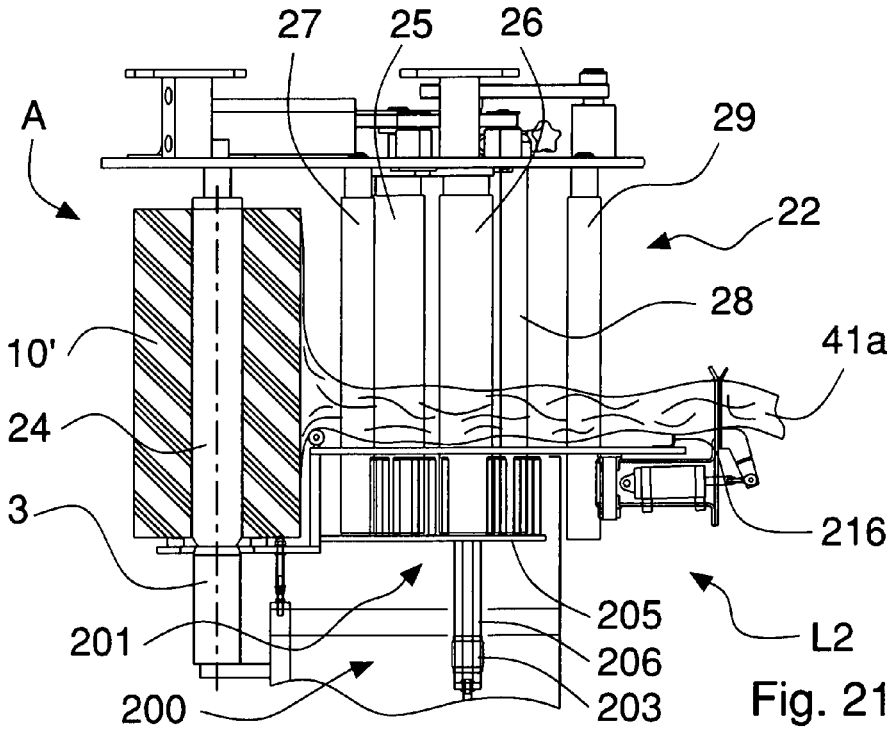
Figure 22:
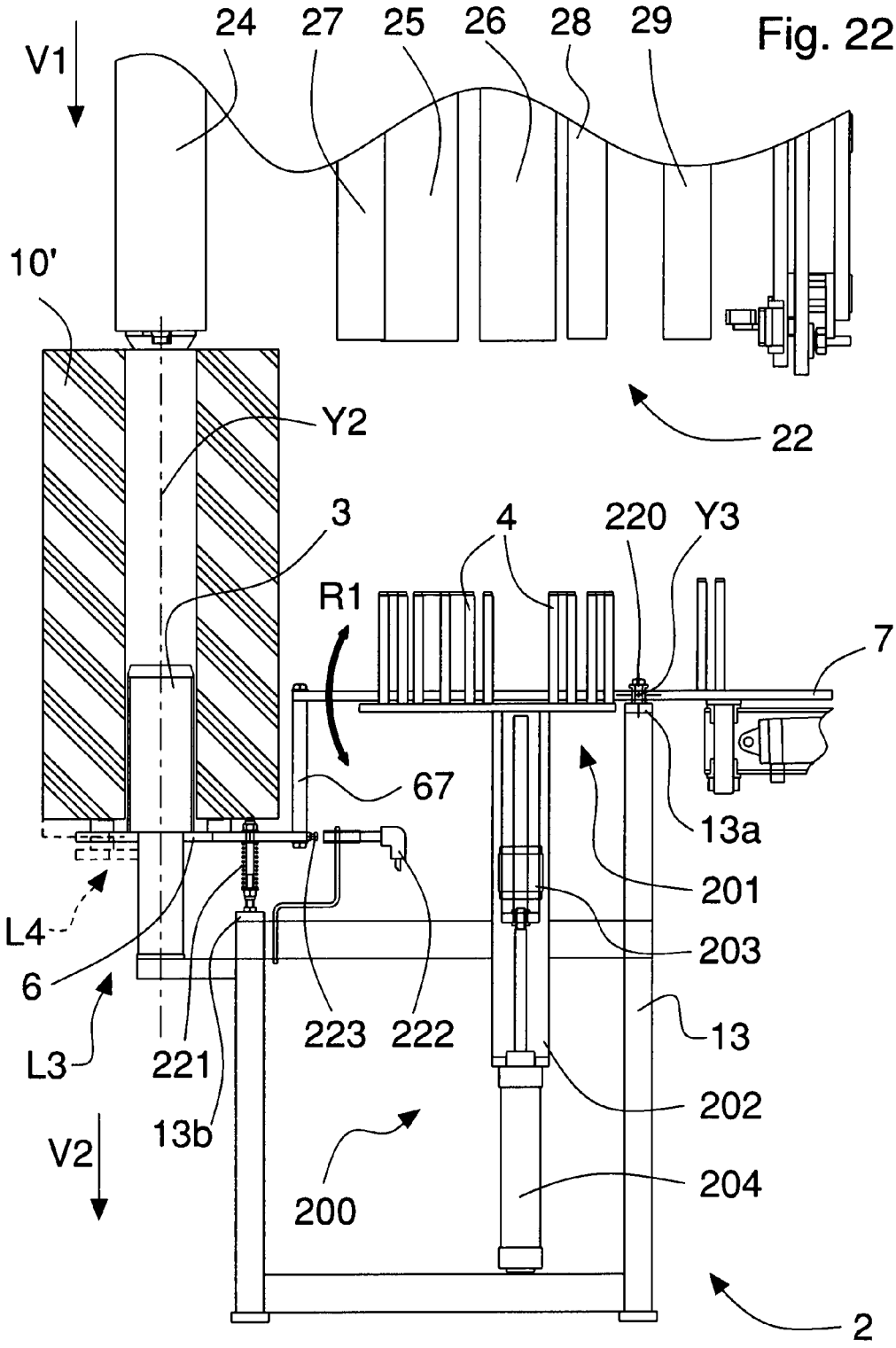

FIG. 3*a*, 3B, 3C are partial schematic respectively frontal and lateral plan views of the apparatus and of the machine in FIG. 1A in an operating position of the reel-holding unit;

FIG. 4A, 4B are partial schematic respectively frontal and lateral plan views of the apparatus and of the machine in FIG. 1A in a reel-change configuration;

FIG. 5A, 5B are partial schematic respectively frontal and lateral plan views of the apparatus and of the machine in FIG. 1A in a work position of the reel-holding unit;

FIG. 6A is a schematic plan view of a reel-changing unit in FIG. 1A, showing elements engaged by an initial portion of film, a first gripping device of said portion in a respective gripping position, a transferring arrangement shown by a dotted line;

FIG. 6B is a view like that in FIG. 6A showing the first gripping device in a tensioning position and rollers of the reel-holding units inserted into curves of the film;

FIG. 7 is an enlarged front view of a reel-changing unit of the apparatus in FIG. 1A;

FIG. 8A is an enlarged front view of a second gripping device of said edge in a rest position;

FIG. 8B is an enlarged view of the second gripping device in a respective gripping position;

FIG. 9 illustrates an enlarged perspective view of a supporting shaft of the reel-holding unit, showing a reel blocking device and a reel pushing device;

FIG. 10 illustrates a fragmentary cross section of the supporting shaft in FIG. 9;

FIG. 11A is an enlarged section of the supporting shaft in FIG. 10, showing a lever in a supporting position;

FIG. 11B is a section like that in FIG. 11A, showing a lever in a reel inserting position;

FIG. 11C is a section like that in FIG. 11A, showing a lever in a reel extracting position;

FIG. 12 illustrates an extracting device for extracting a finished reel in different successive operating positions;

FIG. 13A is a schematic plan view of an embodiment of the apparatus in FIG. 1A, showing a moving arrangement of abutment elements of an initial portion of film in an inserting configuration of said film;

FIG. 13B is a view like that in FIG. 13A, showing a moving arrangement of abutment elements in a wrapping configuration for wrapping said film;

FIG. 14, 15 are respectively frontal and lateral partial schematic views of another embodiment of the apparatus and of the machine in FIG. 1, showing a reel-changing unit in a first operating position and a further reel-changing unit in a second operating position;

FIG. 16 is a lateral partial schematic view of the apparatus and of the machine in FIG. 14 in a reel-change configuration;

FIG. 17 is a lateral partial schematic view of the apparatus and of the machine in FIG. 14 in a work position of the reel-holding unit;

FIG. 18A is a schematic plan view of a reel-changing unit in FIG. 14, showing elements engaged by an initial portion of film in a work position and a first gripping device of said initial portion in a respective gripping position;

FIG. 18B is a view like that in FIG. 18A, in which a supporting arrangement is represented in a partial manner for showing a lifting arrangement better, a first gripping device in a tensioning position and rollers of the reel-holding unit inserted into curves formed by the elements in the initial portion of film;

FIGS. 19 and 20 are respectively lateral and frontal enlarged views of the reel-changing unit in FIG. 18A;

FIG. 21A is a lateral partial view of the reel-changing unit and of the reel-holding unit in a reel-change configuration, in which the elements engaged by the film are in the work position;

FIG. 21B is a view like that in FIG. 21A, showing said elements in a disengaged position;

FIG. 22 is a schematic partial view of a further embodiment of the apparatus of the invention.

With reference to FIGS. 1A to 7, there is illustrated an apparatus 1 comprising a reel-holding unit 22 for a wrapping machine 20 arranged for wrapping a product with a film 40 unwound by a plurality of rollers from a reel 10 and a reel-changing unit 2 suitable for replacing a finished reel 110 with a new reel 10.

The reel-holding unit 22 and the reel-changing unit 2 are in particular reciprocally positionable in a reel-change configuration A so that the new reel 10' can be positioned instead of the finished reel 110.

The wrapping machine 20 comprises a frame 21 suitable for rotatably supporting the reel-holding unit 22, which rotates around a wrapping axis Z of said film 40 around said product 100.

In the configuration illustrated in the figures, the wrapping machine 20 is provided with a movable frame comprising a first ring 31 and a second ring 32. The first ring 31, slidably supported by the frame 21, is vertically movable according to a direction that is virtually parallel to the wrapping axis Z.

The first ring 31 rotatably supports the second ring 32 to which the reel-holding unit 22 is connected. The second ring 32 is rotated around the wrapping axis Z.

The wrapping machine 20 may also be of the rotating arm type, i.e. provided with an arm rotatably fixed to the frame of the machine and bearing at an end a portion elongated vertically, on which the reel-holding unit 22 is slidably fixed.

The latter comprises a supporting element 30 to which the supporting shaft 24 of a reel 10 and a plurality of rollers 25, 26, 27, 28, 29 are fixed that are arranged for unwinding and stretching the film 40 from the reel 10.

The apparatus 1 further comprises a grasping arrangement 50 fixed to the first ring 31 and arranged for grasping and retaining an edge of the film 40 to enable the product 100 to be wound with said film in an initial work step.

The grasping arrangement 50 includes an arm 51 rotatably supported on said first ring 31 and provided at a free end 51*a* with a grasping gripper 52 provided with a pair of jaws 52*a*, 52*b* (FIGS. 8A and 8B).

The arm 51 is driven by a respective driving device 54, for example comprising a pneumatic linear actuator, between a rest position J, in which it is raised and adjacent to the first ring 31, and a respective gripping position K, in which said arm is extended and lowered to grasp the film 40.

The reel-holding unit 22 comprises a first prestretching roller 25 and a second prestretching roller 26, rotating at different speeds so as to unwind the extendible film and stretch or elongate the film by a set percentage and a plurality of deviating or idling rollers 27, 28, 29 provided for deviating the film 40 such that that it winds around the prestretching rollers 25, 26 (FIG. 1A).

The apparatus 1 comprises a pair of reel-changing unit 2, 2' placed on the same operating side as the wrapping machine 20.

Each reel-changing unit 2, 2' is movable between a respective first disengaged operating position C, in which it is relatively spaced from the machine 20, and a second reel-change operating position D, in which it is on the other hand adjacent to the machine 20 to interact with the reel-holding unit 22 in the reel-change configuration A.

In particular, each unit 2, 2' is rotatably supported by a respective connecting plate 23, 23' to the frame 21 of the machine 20, so as to rotate partially around a respective rotation axis X, X', substantially parallel to said wrapping axis Z.

Figure 1C:
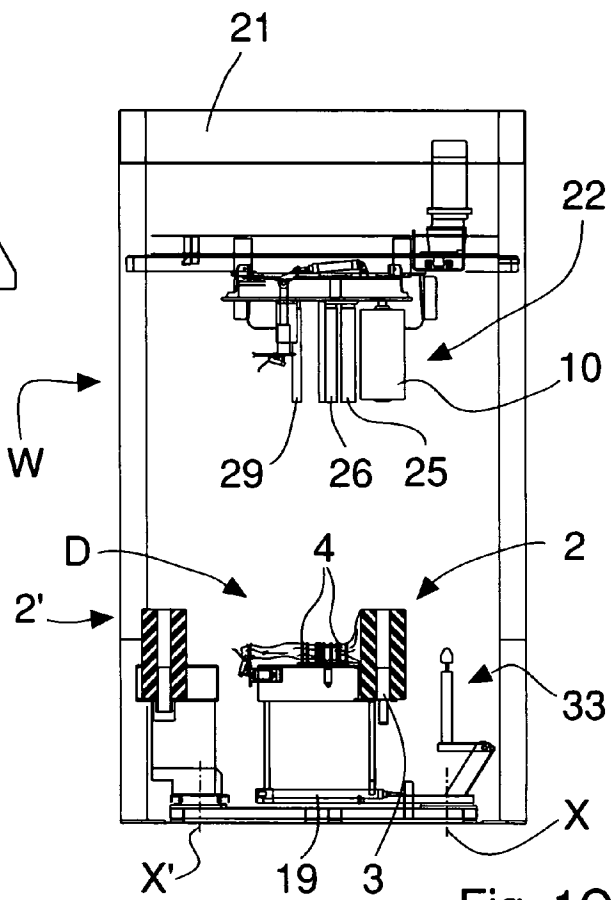
FIGS. 1B and 1C are respectively frontal and lateral schematic views of the apparatus in FIG. 1A, in which a reel-changing unit is in a first operating position and a further reel-changing unit is in a second operating position.
Figure 1B:
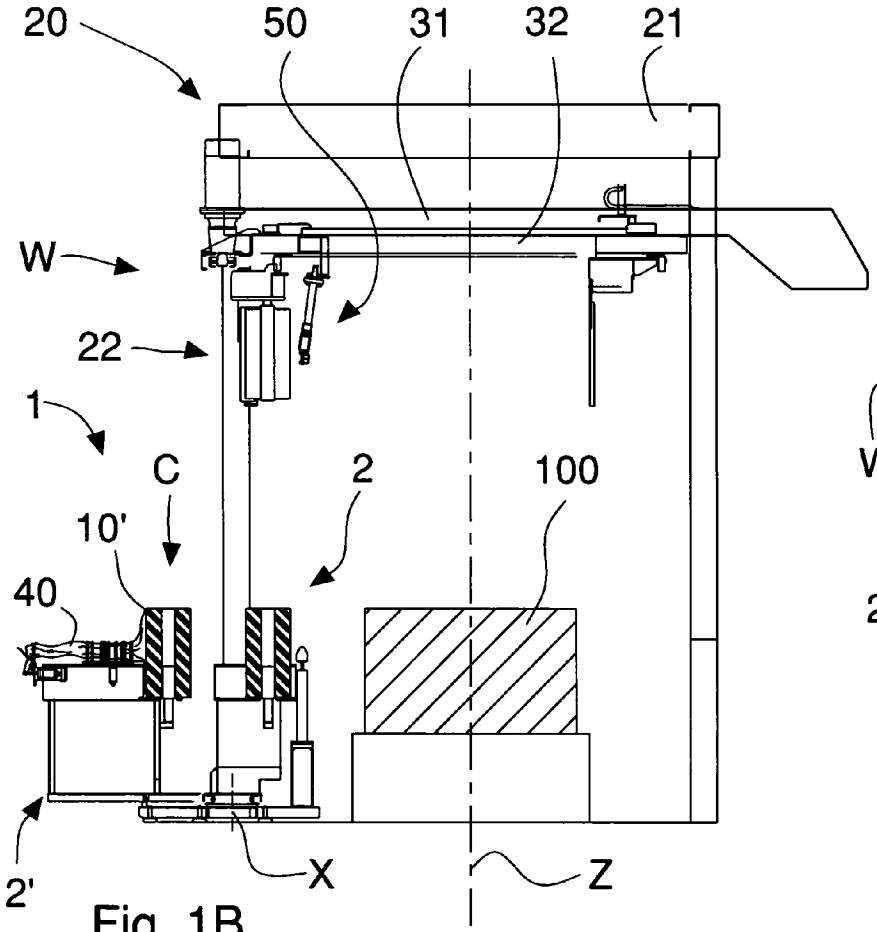

As shown in FIGS. 1B and 1C, when one of the units is in the respective second operating position D, the other unit 2', 2 is in the first operating position C.

The two units 2, 2' are identical, but are rotatably mounted on the respective connecting plates 23, 23' at different points so that during rotation, respectively clockwise and anticlockwise, from the respective first operating position C to the respective second operating position D, the new reels 10' are placed in the same position for subsequent mounting on the first supporting shaft 24.

A driving device 19, 19' is provided for rotating each unit 2, 2' between the two operating positions C, D. The driving device 19, 19' comprises, for example, respective pneumatic or electric linear actuators that connect the respective units 2, 2' to the frame 21.

Each reel-changing unit 2, 2' is provided with a further supporting shaft 3 of the new reel 10' of film 40 and a plurality of elements 4 that define a curvilinear path P along an initial portion 41 of the film 40 of said new reel 10'.

The initial portion 41 is intended to wind the prestretching rollers 25, 26 and the deviating rollers 27, 28, 29 of the reel-holding unit 22 in the reel-change configuration A. More precisely, in this reel-change configuration A, the rollers 25, 26, 27, 28, 29 of the reel-holding unit 22 are positioned at respective curves P1, P2, P3, P4 formed on the initial portion 41 by the elements 4.

The arrangement of the elements 4 is such that at each curve at least one thereof, in particular two or more, is completely interposed between the film 40 and the respective roller.

The unit 2, 2' comprises a supporting frame structure 13 connected to the respective connecting plate 23, 23' and arranged for supporting a supporting arrangement 6, 7 of the further supporting shaft 3 and of the elements 4.

The supporting arrangement comprises a first supporting plate 6 and a second supporting plate 7 connected by a connecting element, fixed to upper portions of the supporting structure 13 and arranged respectively for providing a resting surface for the new reel 10' and for enabling the elements 4 to be fixed.

The further supporting shaft 3 is fixed, for example by a bracket or shelf 14, to the supporting structure 13, so as to protrude partially through a respective passage opening 6*a*' of the first plate 6 (FIG. 7). In this way, the new reel 10' rests on said first plate 6 and is kept in position as it is inserted into said further supporting shaft 3. The latter is further able to slide along its own substantially vertical longitudinal axis Y2 to enable the first supporting shaft 24 to be inserted into the reel 10' in the reel-change configuration A, as explained more in detail further on in the description.

The further supporting shaft 3 is in fact elastically shortenable, between an extended position in which it protrudes from the passage opening 6*a*, and a retracted position in which it is arranged below the first plate 6, because pushed by the first supporting shaft 24 (FIG. 4B).

The further supporting shaft 3 is, for example, of telescopic type and comprises a first portion 3*a* fixed to the bracket 14 and a second portion 3*b* that is able to slide axially on said first portion 3*a*. An elastic element is interposed between the two portions of the further supporting shaft 3 to maintain the latter in the extended position.

The second portion 3*b* can also be arranged for rotating freely around the longitudinal axis Y2 with respect to the first portion 3*a*.

The elements 4, comprising for example elongated cylindrical pins, are connected to the second plate 7 in a fixed manner or are mounted thereupon free to rotate around respective longitudinal axes Y1 (FIG. 7).

A movable gripping device 8 is provided to block a free edge 41*a* of the initial portion 41 of the film 40 and maintain the latter unwound and correctly extended on the elements 4.

The gripping device 8 comprises an arm 9 rotatably connected to the second plate 7 and having on the free end a grasping gripper 11. The gripping device 8 is driven by a first actuating device 16, comprising for example a pneumatic linear actuator, between a gripping position E in which the gripper 11 is nearer the elements 4 to receive and block the free edge 41*a*, and a tensioning position F, in which the gripping device 11 is more distant from the elements 4 so as to tension the film 40.

The tensioning position F is defined geometrically by a mechanical limit stop. This ensures not only that the film 40 is wound correctly around the elements 4, but also the correct subsequent wrapping around the rollers of the reel-holding unit 22, as shown in detail in the continuation of the description.

In an alternative embodiment of the apparatus that is not illustrated, the tensioning position F is not defined by the mechanical limit stop, but is reached when the gripping device 8 exerts on the initial portion 41 of film 40 a set tensioning force.

The reel-changing unit 2, 2' further comprises a transferring arrangement 12 suitable for transferring the initial portion 41 of film wound on the elements 4 to the rollers of the reel-holding unit 22, in the reel-change configuration A (FIGS. 6A and 6B).

The transferring arrangement 12 comprises a shaped plate provided with openings for the passage of the elements 4 and of the rollers 25, 26, 27, 28, 29. Said plate is moved by a respective second actuating device 17 in a direction substantially parallel to the longitudinal axis Y2 of the further supporting shaft 3, so as to abut on and thus move the initial portion 41 of film 40 from the elements 4 to the aforesaid rollers.

The second plate 7 of the unit 2 is provided with a plurality of openings 7*a*, 7*b*, 7*c*, 7*d* that enable the prestretching rollers to be inserted in position in the reel-change configuration A.

Alternatively, the second plate 7 can be provided with these openings and be substantially coplanar, or be in a monobloc, with the first plate 6. In this case, the elements 4 are relatively smaller.

Figure 2A:
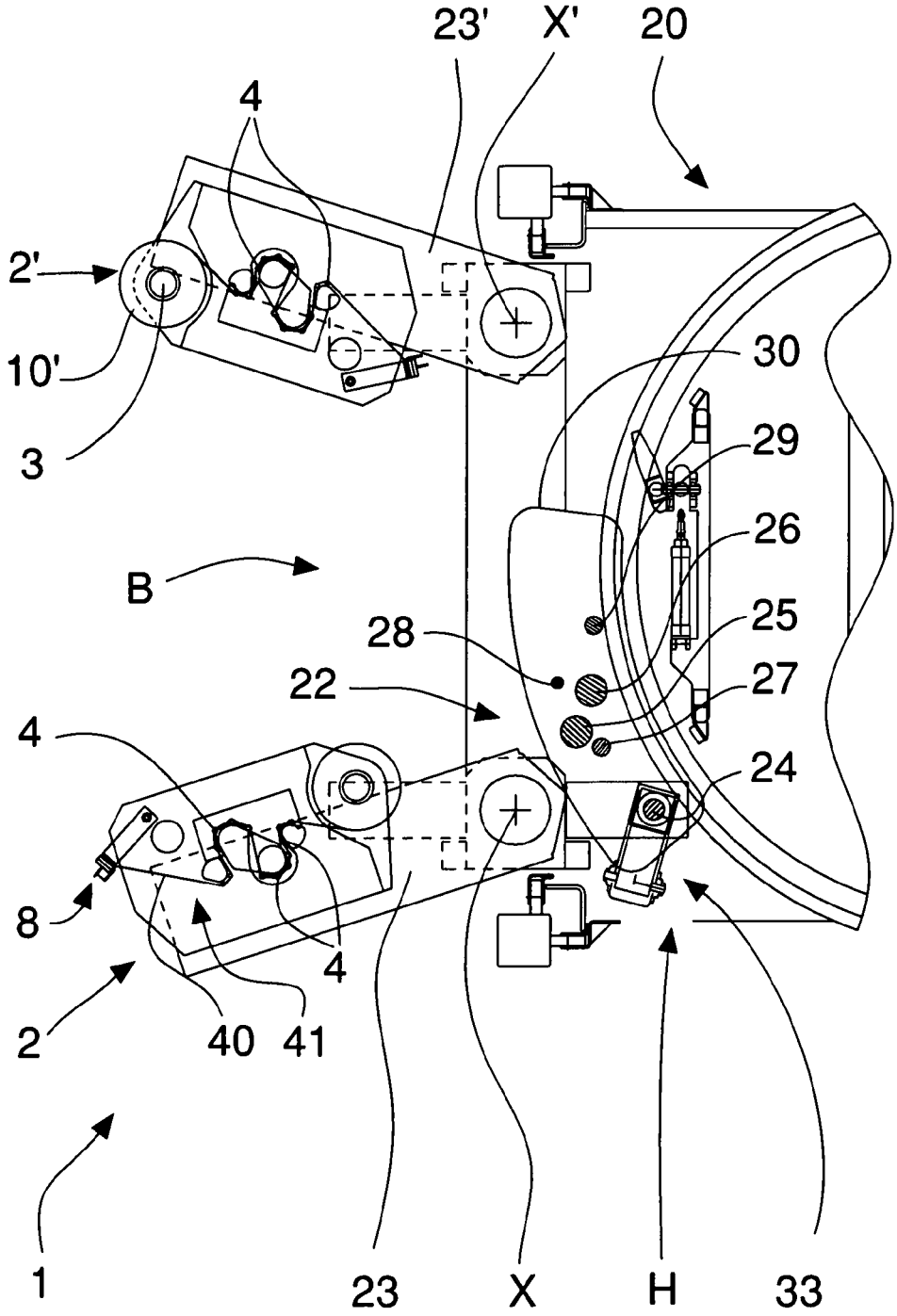
FIG. 2A, 2B, 2C are partial schematic respectively frontal and lateral plan views of the apparatus and of the machine in FIG. 1A, in a finished reel extracting configuration.
Figure 2C:
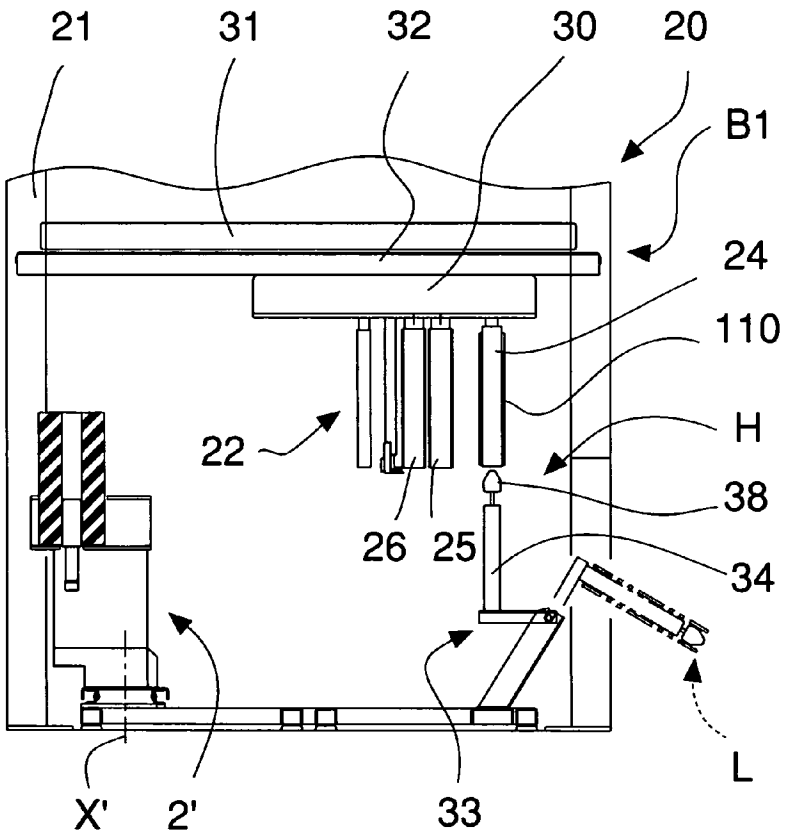
Figure 2B:
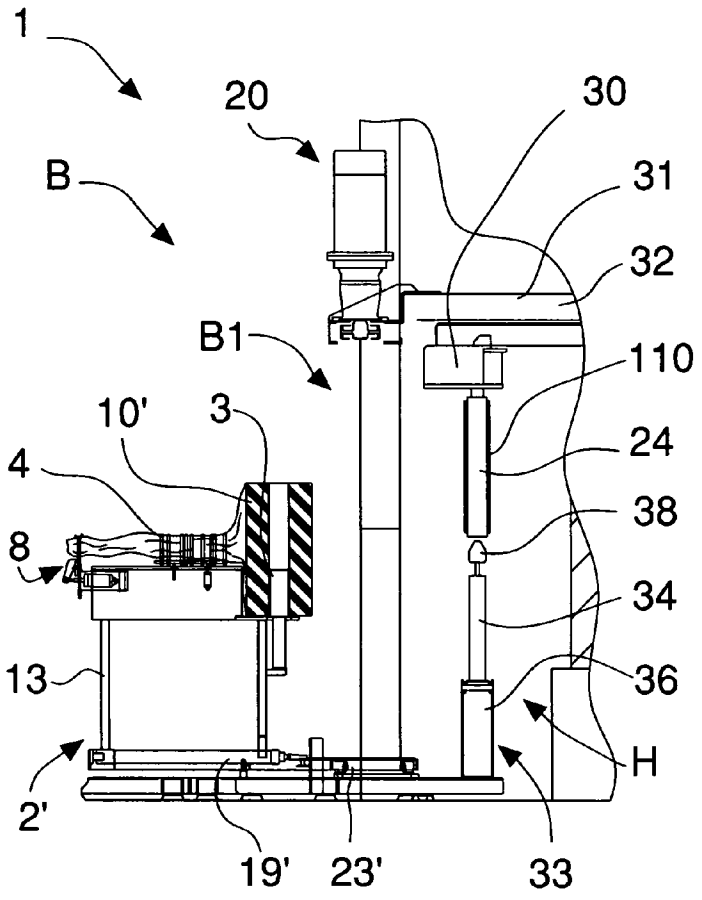

The apparatus 1 further comprises an extracting device 33 of a finished reel 110 positioned at the base of the wrapping machine 20 so as to be reached by the reel-holding unit 22 in a reel-change configuration B (FIG. 2A-2C).

The extracting device 33 comprises an extracting pin 34 having a diameter and a length such as to receive and support the finished reel 110, i.e. a core thereof made of cardboard or plastics.

The extracting pin 34 is rotatably fixed, by a bracket 35, to a supporting arm 36, which is in turn fixed to the frame 21 of the machine 20.

A third actuating device 37, comprising for example a pneumatic linear actuator, is interposed between the bracket 35 and the arm 36 to rotate the pin 34 between an upright position H, in which it is substantially vertical and aligned with the first supporting shaft 24 of the reel-holding unit 22 so as to receive the finished reel 110, and a tilted position L, in which said extracting pin 34 is lowered so as to enable the finished reel 110 to disengage therefrom and slide by gravity into a collecting container (FIG. 12).

The extracting pin 34 further comprises a conical push rod 38 mounted elastically on said pin 34 and slidable axially by a defined quantity. The conical push rod 38 is arranged for opening a blocking device 45 provided on a free end of said first supporting shaft 24.

With reference to FIG. 9 to 11C, the blocking device 45 substantially comprises a pair of blocking levers or jaws 46 fixed rotatably at an end portion 24*a* of the first supporting shaft 24, diametrically opposite one another. The levers 46 are provided with elongated portions 46*a* suitable for abutting on and supporting in an operating condition a core 10*a* of the reel 10.

The blocking device 45 further comprises a control pin 47 slidably mounted inside said end portion 24*a*, substantially coaxial with said supporting shaft 24, and interposed between the two levers 46. In particular, the control pin 47 is inserted into a hole 48*a* of a ring 48 of the supporting shaft 24.

The control pin 47 has a first abutting portion 47*a* comprising a cylindrical external surface and a second tapered terminal abutting portion 47*b* having a substantially conical shape.

The control pin 47 is elastically connected to the end portion 24*a* of the first supporting shaft 24 by a first elastic element 49, for example comprising a coil spring, so as to slide between an extended position M and a retracted position N.

Similarly, the two levers 46 are connected together by a second elastic element 44, for example comprising one or more coil springs.

Each lever 46 has contact portions 46*b*, 46*c* shaped so as to engage the abutting portions 47*a*, 47*b* of the control pin 47.

In this way, each lever 46 may have a plurality of operating positions, in function of the position assumed by the control pin 47, as illustrated in FIG. 11A, 11B, 11C.

When the control pin 47 is in the extended position M, maintained by the respective elastic element 49, the levers 46 are arranged, owing to the action of the second elastic element 44 and to the weight of the reel 10, in a supporting position R, substantially orthogonal to a longitudinal axis Y3 of the supporting shaft 24 (FIG. 11A). In this position, the levers 46 abut on the first cylindrical abutting portion 47*a* of the control pin 47 with respective flat contact portions 46*b*, that prevent further rotation downwards of the levers and thus ensure a stable and solid rest for the reel 10.

With the control pin 47 in the extended position M, it is nevertheless possible to rotate the levers 46 upwards, into a reel insertion position S (FIG. 11B), was in this case the first cylindrical abutting portion 47*a* of the control pin 47 and is abutted by respective cylindrical contact portions 46*c* of said levers 46. In this way, as explained in detail in the rest of the description, it is possible to easily insert the supporting shaft 24 into a new reel 10'.

The levers 46 are replaced in the resting position R by the second elastic element 44.

When the control pin 47 is in the retracted position N, pushed by the conical push rod 38 of the extracting pin 34 of the extracting device 33 into the reel extraction configuration B, the levers 46 are arranged tilted downwards in an extraction position T to enable a finished reel to be removed. This is made possible by the action of the second elastic element 44 and by the fact that the flat contact portions 46*c* of the levers 46 are in contact with the second tapered portion 47*b* of the control pin 47.

A pushing device 55 is further provided that is elastically connected to a further end portion 24*b* of the supporting shaft 24, opposite the end portion 24*a*, and arranged so as to push the reel 10 in the direction of the blocking device 45, so as to facilitate the extraction thereof.

The pushing device 55 comprises a plate 56 suitable for abutting on the reel and slidably connected to the further end portion 24*b* by a plurality of guide pins 57. In particular, the guide pins 57 have an end fixed to the plate 56, the other free end being slidably inserted in a corresponding seat 59 made on the end portion 24*b*. Interposed between pins and seats, there is provided a third elastic element 58, for example comprising coil springs, arranged for maintaining the plate 56 adjacent to said end portion 24*b*, i.e. for exerting an elastic force on said reel.

With particular reference to FIGS. 2A to 5B, operation of the apparatus 1 and of the wrapping machine 20 during an operation of replacing a finished reel 110 with a new reel 10' positioned on one of the two reel-changing units 2, 2' will now be described.

When the reel 110 mounted on the reel-holding unit 22 finishes, the first ring 31 and the second ring 32 are moved respectively rectilinearly and rotationally so as to arrange the reel-holding unit 22 in a first reel-change position B1 (FIG. 2A-2C).

In this position, the first supporting shaft 24 of the reel-holding unit 22 is substantially aligned with the extracting pin 34 of the extracting device 33 that is in the upright position H.

The reel-holding unit 22 is taken to the reel extraction configuration B, i.e. it is further lowered by a quantity that is such as to enable the conical push rod 38 to abut on and push the control pin 47 of the blocking device 45 to the retracted position N, which enables the levers 46 of the blocking device 45 to be rotated downwards. As a consequence, the finished reel 110, through the effect of the weight thereof and owing to the exerted thrust of the plate 56, which is in turn pushed by the third elastic element 58, removes from the first supporting shaft 24 to insert itself into the extracting pin 34.

The reel-holding unit 22 is then raised and taken to a second reel change B2 position through the movement of the first and second ring 31, 32.

At the same time, the extracting pin 34 is rotated to the tilted position L, so as to enable the finished reel 110 to disengage therefrom and drop through gravity, for example into a collecting container.

In the second reel-changing position B2 the reel-holding unit is above one of the two reel-changing units 2, 2' that is in the second operating position D adjacent to the machine 20.

In particular, the reel-holding unit 22 is positioned in such a way that the first supporting shaft 24, now devoid of reel, is substantially aligned with the further supporting shaft 3 of the reel-changing unit 2, i.e. aligned with the new reel 10' to be removed (FIG. 3*a*, 3B, 3C).

In this way, this subsequent lowering of the reel-holding unit 22 to a third reel-change position B3 enables the further supporting shaft 3 to be inserted into the new reel 10', pushing down the further supporting shaft 3, arranging the apparatus 1 and the wrapping machine 20 in the reel-change configuration A.

In particular, whilst the first supporting shaft 24 is progressively inserted into the new reel 10', the levers 46 of the blocking device 45 are free to fold upwards to enable the first supporting shaft 24 to slide inside the reel 10'.

When the end portion 24*a* of the first supporting shaft 24 is inserted into the opening 6*a* of the first plate 6 of the reel-changing unit 2, the levers 46 are free to return to the resting position R. In this way, by successively raising the reel-holding unit 22, the levers 46 are able to abut on and raise the new reel 10'.

In the aforesaid reel-change configuration A, the prestretching rollers 25, 25 and the deviating rollers 27, 28, 29 are positioning at the respective curves P1, P2, P3, P4 that the initial portion 41 of the film 40 forms in virtue of the elements 4.

The elements 4 are entirely interposed between the film 40 and rollers 25, 25, 27, 28, 29 and located by the latter at a distance so as to prevent collisions even in the case of positioning and/or alignment errors.

In the third reel-change position B3 the prestretching rollers and deviators of the reel-holding unit 2 are partially inserted inside the respective openings 7*a*, 7*b*, 7*c*, 7*d* of the second plate 7 of the reel-changing unit 2.

The reel-holding unit 22 is maintained in the third reel-change position B3 for a time required necessary to drive the transferring arrangement 12, with a substantially vertical lifting movement, to enable the initial portion 41 of belt wound on the elements 4 to be transferred to the prestretching rollers 25, 26 and to the deviating rollers 27, 28, 29 (FIG. 4B).

The correct transfer of the portion 41 of film 40 onto the rolls is also ensured by the gripping device 8 that in the tensioning position F exerts on the initial portion 41 of film a set tensioning force.

Alternatively, the gripping device 8 can be driven from the by the gripping position E to the tensioning position F whilst the transferring arrangement 12 moves the film 40 from the elements 4 to the prestretching rollers and deviators. Once the initial portion 41 of film has been transferred the second gripping device 50 is lowered into the respective gripping position K to grasp and retain the free edge 41*a* of the film, which can then be released by the first gripping device 8.

At this point the reel-holding unit 22 is lifted and returned to a work position W ready to start a new operating cycle of wrapping a product 100, whilst the reel-changing unit 2 is returned to the first operating position C to receive a new reel 10'.

It should be observed that loading a new reel 10' onto the unit 2, 2' can be performed whilst the wrapping machine 20 I operational.

The operation of mounting a new reel 10' onto the unit 2 is performed manually by an operator who fits the new reel 10' onto the further supporting shaft 3 and unwinding an initial portion 41 of film 40 therefrom. This portion has to be positioned between the elements 4 so as to form a broken-line curvilinear path P.

The terminal edge 41*a* of the initial portion 41 is retained by the first gripping device 8 that is then driven and taken to the tensioning position F so as to make the initial portion 41 adhere to the elements 4.

The operation of winding onto the latter is significantly eased and simplified by the reduced overall dimensions of the elements 4 and by the fact that they offer minimal resistance to sliding of the film during winding thereof as they are free to rotate around the longitudinal axis Y1 thereof.

With reference to FIGS. 20A and 20B, there is illustrated an embodiment of the apparatus 1 in which the elements 4' are movable, supported and driven by a respective moving arrangement 61, 62, 63, 64.

A first moving arrangement 61 is provided, comprising a lever rotatably fixed to a lower surface 7*a* of the second plate 7 and arranged for supporting two elements 4'.

A second moving arrangement 62, comprising a respective lever, which is also rotatably fixed to the lower surface of the second plate 7, is provided for supporting respective three elements 4'.

A third moving arrangement 63, comprising an element slidably fixed to the lower surface of the second plate 7, supports respective further three elements 4'.

Lastly, a fourth moving arrangement 64 comprising a respective lever rotatably fixed to the lower surface of the second plate 7, is provided for supporting two respective elements 4'.

The shape of the moving arrangement 61, 62, 63, 64 and the slidable or rotating method of fixing the latter to the second plate 7 can vary according to specific constructional needs equal to the number of elements 4' and to the distribution thereof on each of such moving arrangement.

The latter are movable, driven manually or by respective actuator device, for example by pneumatic linear actuators, between two respective operating positions.

In a respective first operating position, to which an inserting configuration U of the initial portion 41 of the film 40 (FIG. 20A) corresponds, the moving arrangement 61, 62, 63, 64 is arranged so as to enable the initial portion 41 of the film 40 to be unwound rapidly and easily from the new reel 10' and the end edge 41*a* to then be fitted to the first gripping device 8. In this inserting configuration U, the elements 4' are generally spaced from the film 40 so as not to hamper the movements of the operator.

Once the edge 41*a* has been blocked on the first gripping device 8 it is possible to arrange the moving arrangement 61, 62, 63, 64 in the respective second operating position, to which a wrapping configuration V corresponds, in which the elements 4' abut on and are partially wound by the initial portion 41.

The first gripping device 8 is moved from the first gripping position E to the tensioning position F, so that the film 40 winds the elements 4 so as to form the curvilinear path P with a desired tensioning force.

This embodiment of the apparatus enables the film 40 preparation procedure on the reel-changing unit 2, 2' to be facilitated and accelerated, at the same time enabling the film 40 to be wound in an optimal manner on the elements 4' for a correct transfer of the latter to the rollers of the reel-holding unit 22.

With reference to FIG. 14 to 21, there is illustrated another embodiment of the apparatus 1 comprising reel-changing units 2, 2' in which the elements 4 are mounted movably so as to be movable between a work position L1, in which they are completely interposed between said film 40 and the rollers of the reel-holding unit 22 (FIG. 19, 21A), and a disengaging position L2, in which they are disengaged and are not interposed between rollers and film 40, so as to enable the latter to adhere to said rollers (FIG. 21B).

The supporting arrangement comprising the first supporting plate 6 and the second supporting plate 7, connected by the connecting element 67 is fixed to upper portions of the supporting structure 13 for supplying a resting surface for the new reel 10' and for enabling the lifting arrangement 200 to be fixed. The latter is arranged for moving the elements 4 in a linear manner between the work position L1 and the disengaging position L2 and vice versa. In particular, the lifting arrangement 200 moves the elements 4 along a direction substantially parallel to the wrapping axis Z of the wrapping machine, i.e. along a virtually vertical direction.

The elements 4, which comprise, for example, elongated cylindrical pins, are fixed to a connecting element 201, for example so as to be free to rotate around respective longitudinal axes Y1.

The connecting element 201 is arranged below the second plate 7 and is moved by the lifting arrangement 200, so that the elements 4 can protrude from respective passage holes of the second plate 7, in the work position L1, or be completely retracted, inside the unit 2, under the second plate 7, into the disengaging position L2.

The lifting arrangement 200 comprises supporting and guide arrangement that includes, for example, an upright 202 fixed to a first end 202*a* thereof, in a substantially vertical manner, to the second plate 7, and a sliding guide 203, fixed to the upright and slidably supporting the connecting element 201. The latter is driven along a linear direction by a respective actuator 204, that comprises, for example, a pneumatic piston or an electric linear motor. The latter is fixed to a second end 202*b* of the upright 202.

The connecting element 201 comprises a first connecting member 205 to which are fixed the elements 4 and having a substantially flat shape, and a second connecting member 206, for example having an elongated profile section shape, fixed substantially orthogonally to the first connecting member 205 and shaped so as to engage slidably in the sliding guide 203. An end of said second connecting member 206 opposite the first connecting member 205 is connected to the actuator 204.

The lifting arrangement 200 may alternatively comprise a screw-nutscrew unit rotated/moved rectilinearly by a rotating actuator.

The free ends of the elements 4 in groups of variable number by means of shaped connecting elements 210 in order to increase the stiffness and structural resistance of the elements 4 (FIG. 19, 20).

A roller 215 is fixed to the second plate 7 at the new reel 10' to facilitate the unwinding of the initial portion 41 of film 40. The roller 215 is mounted free to rotate around a respective longitudinal axis, substantially parallel to the second plate 7.

A reference member 216, comprising for example a shaped blade, is fixed to the second plate 7 at gripping device 8. The reference member 216 is provided for maintaining the free edge 41*a* of the initial portion 41 of film raised and detached from the surface of the second plate 7 so as to encourage better grasping of said edge by the gripping device 8 (FIG. 19).

The second plate 7 of the unit 2 is provided also in this case with a plurality of further openings that enable the prestretching rollers and deviators to be inserted and positioned in the reel-change configuration A.

The operation of this version of the apparatus during the reel-change operation, in which a new reel 10' positioned on one of the two reel-changing unit 2, 2' is mounted on the reel-holding unit 22, is substantially similar to what was previously disclosed.

The reel-holding unit 22 is positioned in such a way that the first supporting shaft 24, devoid of reel, is substantially aligned with the further supporting shaft 3 of the reel-changing unit 2, i.e. aligned with the new reel 10' to be removed (FIG. 14, 15). In this way, this subsequent lowering of the reel-holding unit 22 enables the first supporting shaft 24 to be inserted into the new reel 10', pushing down the further supporting shaft 3, arranging the apparatus 1 and the wrapping machine 20 in the reel-change configuration A (FIG. 16, 21A, 21B).

In the aforesaid reel-change configuration A, the pre-stretching rollers 25, 26 and the deviating rollers 27, 28, 29 are positioned at the respective curves P1, P2, P3, P4 that the initial portion 41 of the film 40 forms in virtue of the elements 4 (FIG. 18B).

The elements 4 are arranged in the work position L1, entirely interposed between film and rollers and in particular positioned by the latter at a distance such as to prevent collisions even in the case of positioning errors and/or of alignment of the reel-holding unit 22 (FIG. 18A).

The rollers of the reel-holding unit 2 are partially inserted inside respective openings of the second plate 7 of the reel-changing unit 2 (FIG. 21A).

The lifting arrangement 200 is then driven so as to lower the connecting element 201, i.e. the elements 4 in the disengaging position L2, below the second plate 7. In this way, the initial portion 41 of film can adhere to wind around the pre-stretching rollers 25, 26 and on the deviating rollers 27, 28, 29 in a fast and effective manner (FIG. 21B).

The dimensions of the passage holes provided for the elements 4 on the second plate 7 are such as not to permit the plastics of the film 40 to be "pinched" or remain trapped between the hole and the element.

The correct transfer of the film 40 portion 41 on the rollers is also ensured by the gripping device 8 that in the tensioning position F exerts a set tensioning force on the initial portion 41 of film (FIG. 18B).

Once the initial portion 41 of film has been transferred, the second gripping device 50 is lowered to the respective gripping position to grasp and retain the free edge 41*a* of the film, which may thus be released by the first gripping device 8.

At this point the reel-holding unit 22 is raised and returned to a work position that is ready for starting a new product 100 winding operating cycle, whilst the reel-changing unit 2 is returned to the first operating position C to receive a new reel 10'.

The mounting operation for mounting a new reel 10' on the reel-changing unit 2 is performed manually by an operator who inserts the new reel 10' on the further supporting shaft 3 and unwinds therefrom an initial portion 41 of film 40. This portion must be positioned between the elements 4 extracted in the work position L1, so as to form a curvilinear path P in a broken line.

The terminal edge 41*a* of the initial portion 41 is retained by the first gripping device 8, which is then driven and taken to the tensioning position F so as to make the initial portion 41 adhere to the elements 4.

The operation of winding on the latter is significantly facilitated and simplified by the reduced dimensions of the elements 4 and by the fact that they provide minimal resistance to sliding of the film during winding thereof as they are free to rotate around the longitudinal axis Y1 thereof.

With reference to FIG. 22, there is illustrated a further embodiment of the reel-changing unit 2 of the apparatus 1 in which the supporting arrangement 6, 7, instead of being fixed stiffly to the supporting structure 13, is mounted thereupon so as to be shiftable to enable the reel 10' and the elements 4 to be moved in the case of contact or a blow of said reel and/or of said elements 4 respectively with the supporting shaft and/or with the rollers of the reel-holding unit 22.

In particular, the supporting arrangement 6, 7 is mounted rotatably on the supporting structure 13. The second plate 7, to which the first plate 6 is stiffly connected by the connecting element 67, is in fact fixed by a hinge 220 to an upper first portion 13*a* of said supporting structure 13, so as to be able to rotate partially in the direction indicated by the arrow R1 in FIG. 8, for example around an oscillating axis Y3.

The oscillating axis Y3 is substantially horizontal and orthogonal to the wrapping axis Z of the machine, i.e. orthogonal from a lowering/raising direction V1 of the reel-holding unit 22 approaching, or moving away from, said reel-changing unit 2.

Rotating the plates 6, 7 anticlockwise with reference to FIG. 8 determines a movement in the direction indicated by the arrow V2 of the new reel 10', supported by the first plate 6, and of the elements 4, connected to the second plate 7.

In particular, by positioning the hinge 220 on the upper portion 13*a* of the supporting structure 13 that is more distant from the first plate 6, it is possible to obtain from a minimum rotation of the supporting arrangement 6, 7 a significant movement of the reel 10'.

The elements 4 can be fixed directly to the second plate 7 or supported by the lifting arrangement 200, the latter being connected to said second plate 7 by means of the upright 202.

A respective elastic element 221 is interposed between the first plate 6 and a second upper portion 13*b* of the supporting structure 13 to maintain the supporting arrangement 6, 7 in a preset reel change operating position L3, and to maintain and/or return the latter to said position in the event of lowering. The elastic element 221 substantially comprises one or more coil springs acting to compress and having respective internal guiding stems.

A further elastic element can be interposed between the second plate 7 and the first upper portion 13*a* of the supporting structure 13.

The hinge 220 may comprise one or more belleville washers of known type that, in addition to enabling partial rotating of the supporting arrangement 6, 7, cooperate with the elastic element 221 to maintain said supporting arrangement 6, 7 in said preset operating position L3.

A sensor 222 is provided for detecting the position of the first plate 6, in particular a movement or lowering thereof with respect to the reel-change operating position L3. The sensor 222 comprises, for example, an electronic sensor of capacitive or inductive type that is able to detect the position of a suitable cam element 223 fixed to the first plate 6.

This embodiment of the apparatus 1 enables possible positioning imprecisions of the reel-changing unit 2 to be avoided with respect to the reel-holding unit 22, and vice versa, which may cause in the reel-change step undesired and equally dangerous collisions and blows between the various elements and components.

During operation, if the supporting shaft 24 of the reel-holding unit 22 is not aligned—within a certain degree of tolerance—with the longitudinal axis Y2 of the further supporting shaft 3, it collides with the reel 10' in the descent movement V1 of the reel-holding unit 22 on the reel-changing unit 2. This collision causes a downward movement of the new reel 10' and thus causes the supporting arrangement 6, 7 to rotate from the reel-change operating position L3 to a lowered position L4. This rotation, contrasted elastically by the elastic means element 221 and possibly by the hinge 220, is detected by the sensor 222 that sends a corresponding alarm signal to an electronic control unit of the wrapping machine 20. The electronic control unit readily blocks the descent movement of the reel-holding unit 22, preventing damage and breakages to the structure of the reel-holding unit 22 and/or to that of the reel-changing unit 2. In fact, the amount of lowering required to activate the sensor 222 is greatly reduced. Consequently, even the extent of the rotation that the supporting arrangement 6, 7 has to be able to perform is very modest.

As the same time, the elastic element 221 enables the blow to be absorbed that is generated by the collision, preserving from anomalous and potentially dangerous stress both the supporting shaft 24 of the reel-holding unit 22 and the supporting structure 13 of the reel-changing unit 2.

When the reel-holding unit 22 is raised and removed from the reel-changing unit 2, the elastic element 221 returns the supporting arrangement 6, 7 and thus the new reel 10' and the elements 4 to the reel change L3 operating position.

It is clear that this embodiment of the reel-changing unit 2 enables the apparatus 1 and the wrapping machine 20 to be preserved from breakages and damage following errors or positioning imprecisions of the reel-holding unit 22 and/or of the reel-changing unit 2. In the event of a collision of the supporting shaft with the new reel, the supporting arrangement 6, 7, by rotating elastically, enables the shock to be absorbed. As the same time the sensor 222 by detecting this rotation or lowering generates a stop signal for the wrapping machine.

In still another embodiment of the apparatus 1 that is not illustrated, the supporting arrangement 6, 7 of the reel-changing unit 2 is connected slidably to the supporting structure 13, so as to be movable, in the event of a contact, along a linear direction substantially parallel to the lowering/lifting position V1 of the reel-holding unit 22. In particular, the supporting arrangement 6, 7 is mounted slidably on respective fixed linear guides to the supporting structure 13 and maintained and/or returned to the reel-changing operating position L3 by the further elastic element.

The invention claimed is:

1. Apparatus comprising a reel-holding unit for a wrapping machine for wrapping a product with a film unwound by a plurality of rollers from a reel and a reel-changing unit provided with a new reel for automatically replacing a finished reel mounted in said reel-holding unit with said new reel, said reel-holding unit and said reel-changing unit being arranged in a reel-change configuration wherein said new reel can be positioned in place of said finished reel, said reel-changing unit including a plurality of vertical elements that define a curvilinear path for an initial portion of said film from said new reel, said elements being arranged in said reel-change configuration such that when a roller of said plurality of rollers is positioned at a curve, at least one of said elements is completely interposed between said film and said roller, said reel-changing unit further comprising a lifting arrangement for moving said elements linearly in a vertical direction between a work position wherein said at least one element is completely interposed between said film and said roller and a disengaging position wherein said at least one element is not interposed between said film and said roller to allow said film to wrap around said roller, said reel-changing unit further comprising supporting means and connecting means, said supporting means including a first plate for supporting the new reel and a second plate for fixing the lifting arrangement, said vertical elements being connected with said connecting means, said connecting means being arranged below said second plate and moved by said lifting arrangement between a work position wherein said vertical elements protrude from respective passage holes in said second plate to engage the film and a disengaging position wherein said vertical elements are retracted within said reel-changing unit under said second plate.

2. Apparatus according to claim 1, wherein said elements are positionable in said reel-change configuration such that at least two of said elements are interposed between said film and said roller at a curve.

3. Apparatus according to claim 1, wherein said elements are rotatably free mounted around a respective longitudinal axis.

4. Apparatus according to claim 1, wherein said reel-holding unit comprises a supporting shaft of said reel and a plurality of prestretching rollers and of deviating rollers.

5. Apparatus according to claim 4, comprising a blocking device arranged for constraining a reel to said supporting shaft.

6. Apparatus according to claim 1, wherein said reel-changing unit comprises a further supporting shaft of said new reel.

7. Apparatus according to claim 4, wherein said reel-changing unit comprises a further supporting shaft of said new reel and said further supporting shaft is arranged such that said supporting shaft is insertible in said new reel in said reel-change configuration.

8. Apparatus according to claim 7, wherein said further supporting shaft is shortenable along a longitudinal axis thereof for enabling said supporting shaft to be introduced into said new reel.

9. Apparatus according to claim 1, wherein said reel-changing unit comprises a gripping device arranged for blocking an edge of said initial portion so as to maintain said edge in contact with said elements.

10. Apparatus according to claim 9, wherein said gripping device is movable between a gripping position, in which said gripping device is nearer said elements for receiving and blocking said free edge, and a tensioning position, wherein said gripping device is more distant from said elements so as to tension and wrap said film on said elements.

11. Apparatus according to claim 10, comprising a first actuating device suitable for moving said gripping device.

12. Apparatus according to claim 10, wherein said supporting arrangement comprises a first plate, suitable for supporting said new reel and a second plate, suitable for supporting said elements and said gripping device comprises an arm rotatably connected to said second plate and provided in a free end thereof with a grasping gripper.

13. Apparatus according to claim 1, wherein said elements are arranged in said reel-change configuration and in said work position such that at least two of said elements are interposed between said film and said roller at a curve.

14. Apparatus according to claim 1, wherein said lifting arrangement comprises a connecting element to which said elements are fixed and which is slidably connected to said reel-changing unit through a guiding and supporting arrangement.

15. Apparatus according to claim 14, wherein said lifting arrangement comprises a respective actuator device for moving said connecting element.

16. Apparatus according to claim 14, wherein said guiding and supporting arrangement comprises an upright fixed to a supporting arrangement and/or to a supporting structure of said reel-changing unit, and a guiding member connected to said upright and arranged for slidably supporting said connecting element.

17. Apparatus according to claim 16, wherein said connecting element comprises a first connecting member to which are fixed said elements and a second connecting member shaped so as to engage slidably in said guiding member.

18. Apparatus according to claim 1, wherein said supporting arrangement is mounted movably so as to enable a movement of said reel and of said elements in the case of contact of said reel and/or of said elements with said reel-holding unit.

19. Apparatus according to claim 18, wherein said supporting arrangement is mounted rotatably on a supporting structure of said reel-changing unit by a hinge.

20. Apparatus according to claim 19, wherein said hinge comprises a spring.

21. Apparatus according to claim 19, comprising an elastic element interposed between said supporting arrangement and said supporting structure and arranged for elastically opposing said movement of said supporting arrangement and for maintaining said supporting arrangement in, and/or returning said supporting arrangement to, a preset reel-change operating position.

22. Apparatus according to claim 18, comprising a sensor suitable for detecting said movement of said supporting arrangement and generating a corresponding alarm signal.

23. Apparatus according to claim 1, wherein said reel-changing unit is movable between a first operating position, wherein said reel-changing unit is spaced from said machine, and a second operating position, wherein said reel-changing unit is substantially adjacent to said wrapping machine.

24. Apparatus according to claim 23, wherein said reel-changing unit is rotatable between said operating positions around a respective axis.

25. Apparatus according to claim 24, wherein said reel-changing unit is rotatably connected to a frame of said machine.

26. Apparatus according to claim 24, comprising a driving device suitable for moving said reel-changing unit.

27. Apparatus according to claim 23, comprising two reel-changing units fixed opposite one another on the same side of said wrapping machine.

28. Apparatus according to claim 1, comprising an extracting device suitable for removing and receiving said finished reel from said reel-holding unit in a reel extraction configuration.

29. Apparatus according to claim 1, comprising a grasping arrangement fixed to said wrapping machine and arranged for grasping and blocking, in said reel-change configuration, said initial portion of film.

* * * * *